US005463376A

United States Patent [19]

Stoffer

[11] Patent Number: 5,463,376

[45] Date of Patent: Oct. 31, 1995

[54] SYSTEM AND METHOD FOR SYNCHRONIZING A RECEIVER OF AN ELECTRONIC ARTICLE SURVEILLANCE SYSTEM AND A TRANSMITTER THEREOF

[75] Inventor: James F. Stoffer, Miamisburg, Ohio

[73] Assignee: Sensormatic Electronics Corporation, Deerfield Beach, Fla.

[21] Appl. No.: 78,457

[22] Filed: Jun. 16, 1993

Related U.S. Application Data

[63] Continuation of Ser. No. 530,900, May 29, 1990, Pat. No. 5,300,922.

[51] Int. Cl.[6] ..... G08B 13/187

[52] U.S. Cl. ..... 340/572; 340/551

[58] Field of Search ..... 340/572, 551

[56] References Cited

U.S. PATENT DOCUMENTS 4,429,302 1/1984 Vandebuilt ..... 340/572

5,103,209 4/1992 Lizzi et al. ..... 340/572

*Primary Examiner*—Glen Swann

*Attorney, Agent, or Firm*—Robin, Blecker, Daley & Driscoll

[57] ABSTRACT

An electronic article surveillance system of type including a transmitter for providing in a preselected area an electromagnetic field periodically swept in frequency over a predetermined range of frequencies for causing tags in the preselected area to generate tag signals containing a frequency within the predetermined range of frequencies and a receiver including a detector for receiving the tag signals and providing output indication of detected tag signals, has a modulator in its transmitter which modulates the electromagnetic field and a modulation responsive circuit in its receiver for synchronizing the detector with the frequency of the electromagnetic field.

13 Claims, 9 Drawing Sheets

SYSTEM AND METHOD FOR SYNCHRONIZING A RECEIVER OF AN ELECTRONIC ARTICLE SURVEILLANCE SYSTEM AND A TRANSMITTER THEREOF

This application is a continuation of application Ser. No. 530,900 filed May 29, 1990, now U.S. Pat. No. 5,300,922.

BACKGROUND OF THE INVENTION

1. Field of the Invention

This invention relates generally to electronic article surveillance systems and, more particularly, to electronic article surveillance systems of the type that detect a resonant marker or tag that is placed in a swept frequency electromagnetic field near the exit to a protected area. The system detects perturbations or tag signals that are generated when the frequency of the swept field passes through the resonant frequency of the tag to provide an alarm signal.

2. Description of the Prior Art

Swept frequency electronic article surveillance systems are known. One such system is described in U.S. Pat. No. 4,812,822. One of the problems that is encountered by electronic article surveillance systems, including the one described in the afore-mentioned U.S. Pat. No. 4,812,822, is that the signal produced by the marker or tag is generally quite small and the systems must work in noisy environments and be able to discriminate a valid tag signal from spurious radiations. Such spurious radiations may take the form of interfering carriers and resonances that have the same characteristics as a tag signal but are caused by building structures or other metallic structures in the vicinity that have resonance characteristics similar to those of a tag.

In order to provide the required discrimination between a tag signal and a spurious signal, the systems according to the prior art utilize relatively elaborate signal processing techniques including auto-correlation and various filtering techniques including synchronous integration, as described in the aforementioned mentioned U.S. Pat. No. 4,812,822, to discriminate between a valid tag signal and spurious signals or to filter out spurious signals. Other examples of attempts to eliminate spurious signals are disclosed in U.S. Pat. Nos. 4,117,466 and 4,168,496. U.S. Pat. No. 4,117,466 addresses the problem of filtering out an interfering carrier by detecting the beat frequency produced by the interfering carrier and the swept carrier of the system and inhibiting the alarm. The system disclosed in U.S. Pat. No. 4,168,496 addresses the problem of spurious signals produced by resonant structures in the area that generate a signal that looks like a tag signal. In the aforementioned mentioned system, the spurious tag-like signal is sampled and stored, and the stored signal is subsequently subtracted from the received signal to thereby cancel out the spurious signal from the received signal so that it is not detected as a valid tag signal. While the aforementioned systems do provide a way to distinguish between spurious and valid tag signals, they are relatively complex and different approaches must be taken to discriminate against different types of interfering signals, such as interfering carriers and resonances.

SUMMARY

It is an object of the present invention to overcome many of the disadvantages of the prior art systems.

It is yet another object of the present invention to provide a system that discriminates between valid tag signals and spurious signals without utilizing extensive signal processing.

It is yet another object of the present invention to provide an electronic article surveillance system that is better able to discriminate between valid tag signals and spurious signals.

It is yet another object of the present invention to provide an electronic article surveillance system that identifies a spurious signal based on how rapidly it appears and utilizes gating techniques to gate out the spurious signal once it has been identified.

It is yet another object of the present invention to provide a system that utilizes a common approach and circuitry to discriminate against different types of spurious signals including carriers and resonances.

It is another object of the present invention to provide a system that can discriminate between tag signals and signals that are generated by other objects, but have characteristics that are similar to tag signals.

It is another object of the present invention to provide an electronic article surveillance system that monitors the amplitude and frequency characteristics of signals present in the environment and provides a diagnostic display indicating the characteristics of the environment.

It is yet another object of the present invention to provide a swept frequency electronic article surveillance system wherein the receiver receives synchronizing information from the swept transmitter signal to thus eliminate the need for an interconnecting synchronizing line.

It is another object of the present invention to provide an electronic article surveillance system that utilizes an adaptive threshold whose setting is based not only on the amplitude of the received interfering signal, but on its synchronocity.

It is yet another object of the present invention to provide an electronic article surveillance system wherein the adaptive threshold circuit is used in conjunction with a notch circuit wherein the notch circuit notches out periodically occurring signals thereby permitting the adaptive threshold to be set at a low level to maintain full sensitivity without causing false warnings.

In accordance with the present invention, a swept frequency transmitter, whose frequency is swept over a range of frequencies encompassing the resonant frequency of a resonant tag, generates a signal that is applied to a transmitting antenna located at an exit to a protected area. A receiving antenna is also located at the exit to the protected area and is spaced from the transmitting antenna so that anyone exiting the protected area must pass between the transmitting and receiving antennas. The receiving antenna is connected to receiving and processing circuitry that detects the presence of a tag passing between the receiving and transmitting antennas.

In accordance with one aspect of the invention, phase shift networks are interposed between the transmitter and the transmitting antenna and between the receiver and the receiving antenna to optimize the coupling between the transmitter and transmitting antenna and the receiver and receiving antenna and to provide the optimum field distribution between the transmitting and receiving antennas. However, it has been found that the coupling networks provide a variable attenuation to the swept signal as it is swept over its range of frequencies, thus amplitude modulating the signal received by the receiver at the transmitter sweep rate. Thus, by applying the amplitude modulated signal to synchronization circuitry within the receiver, the receiver can be synchronized to the sweep frequency of the transmitter without the need for interconnecting lines.

In addition, the detected signal is applied to an adaptive threshold circuit and pulse detector that detects the occurrence of a pulse. Each time a pulse is detected, a processor determines when the next pulse should be received if the pulse is a tag pulse based on the known sweep frequency of the transmitter. Pulses received at times other than the predicted time are ignored. If pulses are repeatedly received at the predicted time, it is likely that a tag is present; however, if the pulses continue to be received for more than a predetermined time interval, they are likely caused by a spurious signal, and the threshold of the adaptive threshold is increased so that the pulses are ignored. In addition, pulses from the pulse detector are applied to a notch pulse generator circuit that detects recurring pulses at a particular portion of the swept frequency range and utilizes gating circuitry to notch out such pulses if they persist for a predetermined time period, thereby effectively notching out interfering carriers and resonances that persist for longer time periods than a tag signal would normally persist. Once an interfering signal has been notched out, the threshold of the pulse detector circuit is lowered to maintain system sensitivity even in the presence of an interfering signal. Subsequent signals are analyzed, and if a signal that is in synchronism with the sweep frequency of the transmitter is detected, and if the amplitude of the detected signals rises and falls rapidly, such a signal is characteristic of a tag signal, generated when a tag moves through the protected zone, and an alarm is sounded. A diagnostic display is provided so that a person analyzing the performance of the system and the environment may readily be able to determining the conditions of the environment in which the system is located.

In addition, circuitry capable of distinguishing between a tag and other objects present in the vicinity or being carried through a protected exit that generate signals that are similar to tag signals may be provided. A circuit that disables the system to prevent false alarm in the event of transmitter failure is also provided.

BRIEF DESCRIPTION OF THE DRAWING

These and other objects and advantages of the present invention will become readily apparent upon consideration of the following detailed description and attached drawing, wherein.

DETAILED DESCRIPTION OF THE PREFERRED EMBODIMENT

Figure 1:
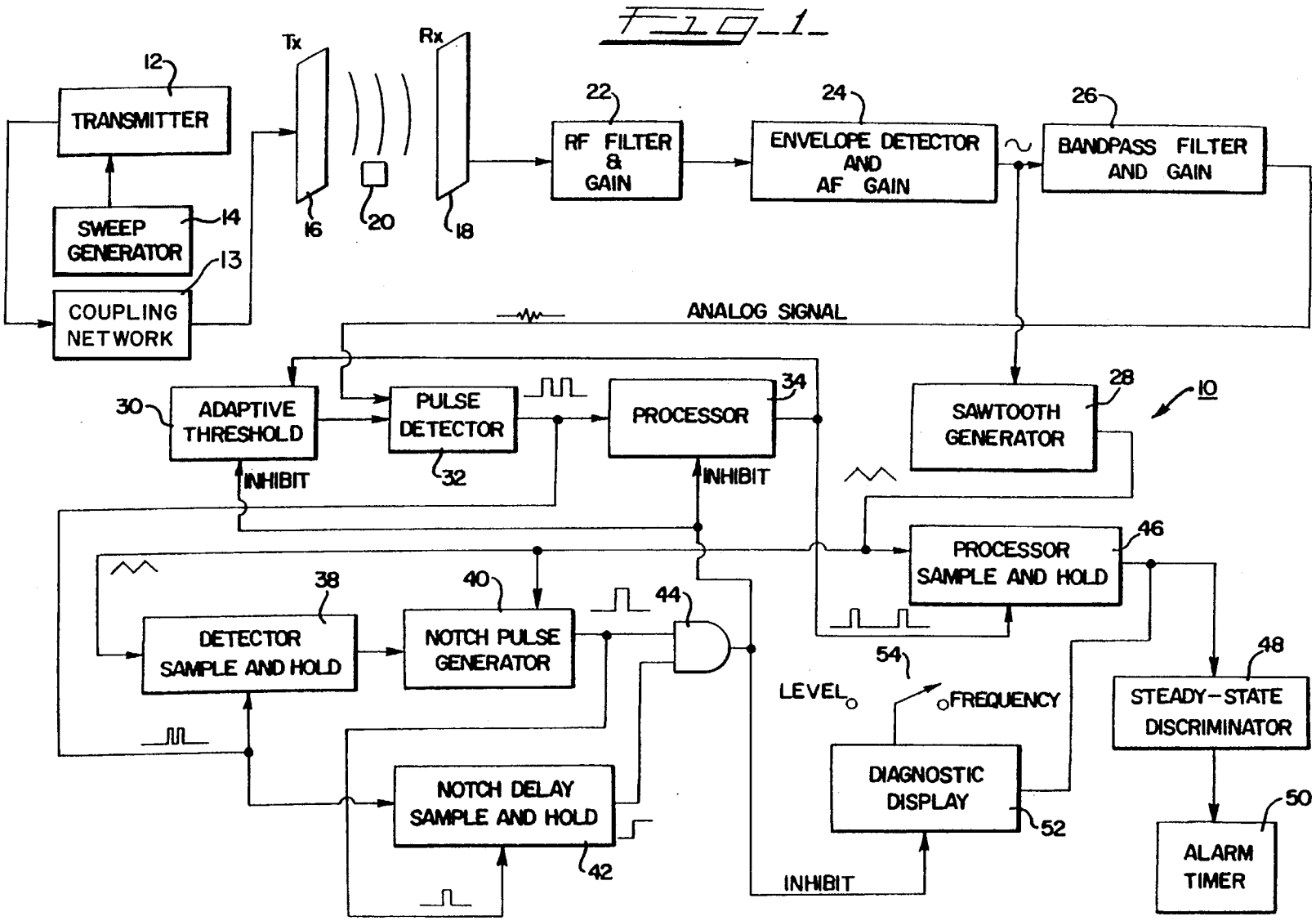
FIG. 1 is a block diagram of the system according to the invention.

Referring now to the drawing, with particular attention to FIG. 1, there is shown a block diagram of the system according to the present invention, generally designated by the reference numeral 10. The system utilizes a transmitter 12 whose transmitting frequency is swept over a range of frequencies by a sweep generator 14. In the illustrated embodiment, the transmitter is swept over a range of frequencies from 7.4 mHz to 8.8 mHz at a sweep rate of 178 Hz, but it should be understood that other transmitting frequencies and other sweep frequencies may be used. The output of the transmitter 12 is applied to a transmitting antenna 16 that is located at an exit to an area protected by the system 10. A receiving antenna 18 is also located at the exit to the protected area in a spaced relationship from the transmitting antenna 16 so that a tag, such as a resonant L-C tag 20, or other tag, whether active or passive, passing between the transmitting antenna 16 and the receiving antenna 18 will be detected. The output of the receiving antenna 18 is applied to a receiver that includes a radio frequency filter and gain circuit 22 that is tuned to the range of frequencies transmitted by the transmitter 12. The output of the radio frequency filter and gain circuit 22 is connected to an envelope detector and audio frequency gain circuit 24, which envelope-detects the output of the radio frequency filter and gain circuit 22 and amplifies the detected signal. The output of the envelope detector and audio frequency gain circuit 24 is applied to two signal processing channels: a bandpass filter and gain circuit 26 that provides an analog signal that includes any signal from the tag 20, and a synchronizing channel that includes a sawtooth generator 28. The sawtooth generator 28 generates a sawtooth whose amplitude is proportional to the instantaneous frequency of the transmitted swept frequency signal and is used to synchronize the receiver signal processing circuitry to the transmitter sweep frequency.

The bandpass filter and gain circuit 26 has a pass band centered about 4 kHz and is operative to pass signal components in the range of frequencies generated by the tag 20 and to reject other signals, such as the 178 Hz sweep frequency. The output of the bandpass filter and gain circuit 26 is applied to a pulse detector circuit 32 that provides an output pulse whenever the signal from the bandpass filter and gain circuit 26 exceeds a predetermined threshold. This threshold is a DC voltage level that is adjusted automatically by the adaptive threshold circuit 30, later described. The purpose of the adaptive threshold circuit 30 is to increase the detection threshold of the pulse detector 32, thereby reducing receiver sensitivity in the presence of environmental noise. In the absence of noise, the threshold of the adaptive threshold circuit 30 is set low to optimize system sensitivity.

The adaptive threshold circuit works in conjunction with the pulse detector 32 to provide an output pulse whenever the threshold of the adaptive threshold circuit 30 is exceeded. The pulse from the pulse detector 32 is applied to a processor 34. The processor 34 operates much like a timer and gate circuit that permits the passage of a first pulse therethrough, but prevents the passage of additional pulses for a predetermined time thereafter. In the present case, the predetermined time is almost equivalent to the time required for the sweep generator 14 to complete one full sweep of its sweep cycle. The reason for this is that if a valid tag pulse were detected, the next tag pulse whose occurrence could be predicted would occur one sweep time later. Thus, if the signal detected were a tag pulse, the next predictable tag pulse would occur one sweep later, and anything in between (other than the tag pulse on the return sweep, whose time of occurrence is not predictable) would be noise or interference and is gated out. When valid tag pulses are applied to the processor 34, the processor will output a stream of pulses which are very narrow and evenly spaced, since they are synchronized to the transmitter sweep. Noise or interference signals are not synchronized to the transmitter sweep, and therefore consecutive pulses seen at the output of the processor 34 will vary in pulse width and timing. The output of the processor 34 is provided to the adaptive threshold circuit 30 where the pulses are integrated to produce a DC voltage level. This DC voltage level slowly varies according to how closely the pulses from the pulse detector 30 are synchronized to the transmitter sweep. The DC voltage from the adaptive threshold 30 is applied as a reference voltage to the pulse detector 32. Thus, when detector pulses appear which are synchronized to the transmitter sweep, the processor 34 provides narrow pulses to the adaptive threshold circuit 30, which integrates the pulses to produce a threshold voltage which is gradually increased until the pulses are not detected, or they appear less synchronous. The response time of the adaptive threshold 30 is slow compared to the pulse amplitude increase seen at the output of the bandpass filter and gain stages 26 when a tag moves through the protected zone. Therefore, a tag signal which is changing in amplitude will be detected by the pulse detector 32, while a signal which is synchronous but stationary in amplitude will be rejected. Periodically occurring signals resulting from interfering sources such as interfering carriers or from resonant circuits in the vicinity of the system generally persist for a longer period of time than is required for a tag to pass between the antennas 16 and 18, and consequently, long duration signals are not considered to be tag signals and the threshold is raised so that such long duration signals are ignored.

In addition, the output of the pulse detector 32 is applied to notch pulse circuitry including a detector sample and hold circuit 38, a notch pulse generator 40, a notch delay sample and hold 42 and an AND gate 44. The function of the notch generating circuitry is to identify pulses from the pulse detector 32 that are likely to be caused by interfering carriers or resonances in the area, and to gate them out, for example, by inhibiting the processor 34, so that they will not cause an alarm to be generated. The adaptive threshold circuit 30 will also be disabled, and thus not desensitize the system once the interference pulses have been identified and gated out. The output of the processor 34 is applied to further processing circuitry, including a processor sample and hold circuit 46 and a steady state discriminator 48 that further analyzes the output of the processor 34 for a signal of the type caused by a tag,.namely, a signal that recurs at the sweep frequency of the sweep frequency generator 14 and rises quickly as the tag enters the area between the antennas 16 and 18, persists for a short period of time, and then decays rapidly as the tag 20 exits the area. Upon the occurrence of such a signal, the steady state discriminator 48 will apply a signal to an alarm timer 50 that will trigger an alarm for a predetermined time period. The operation of the processor sample and hold circuit 46 and the steady state discriminator 48 will be discussed in greater detail in conjunction with FIGS. 2 and 3 as will be the operation of the adaptive threshold circuitry and the notch pulse circuitry.

In accordance with another important aspect of the present invention, a diagnostic display circuit 52 monitors the condition of the processor sample and hold circuitry 46 to provide an indication to a technician or installer of the environmental conditions at the installation site. The diagnostic display can provide in easily readable form the amplitudes and frequencies of any interfering signals and indicate whether such signals are random noise or repetitively occurring signals such as those produced by interfering carriers or resonances. A switch 54 determines whether the diagnostic display displays the frequencies or amplitudes of the signals in the environment.

Figure 2:
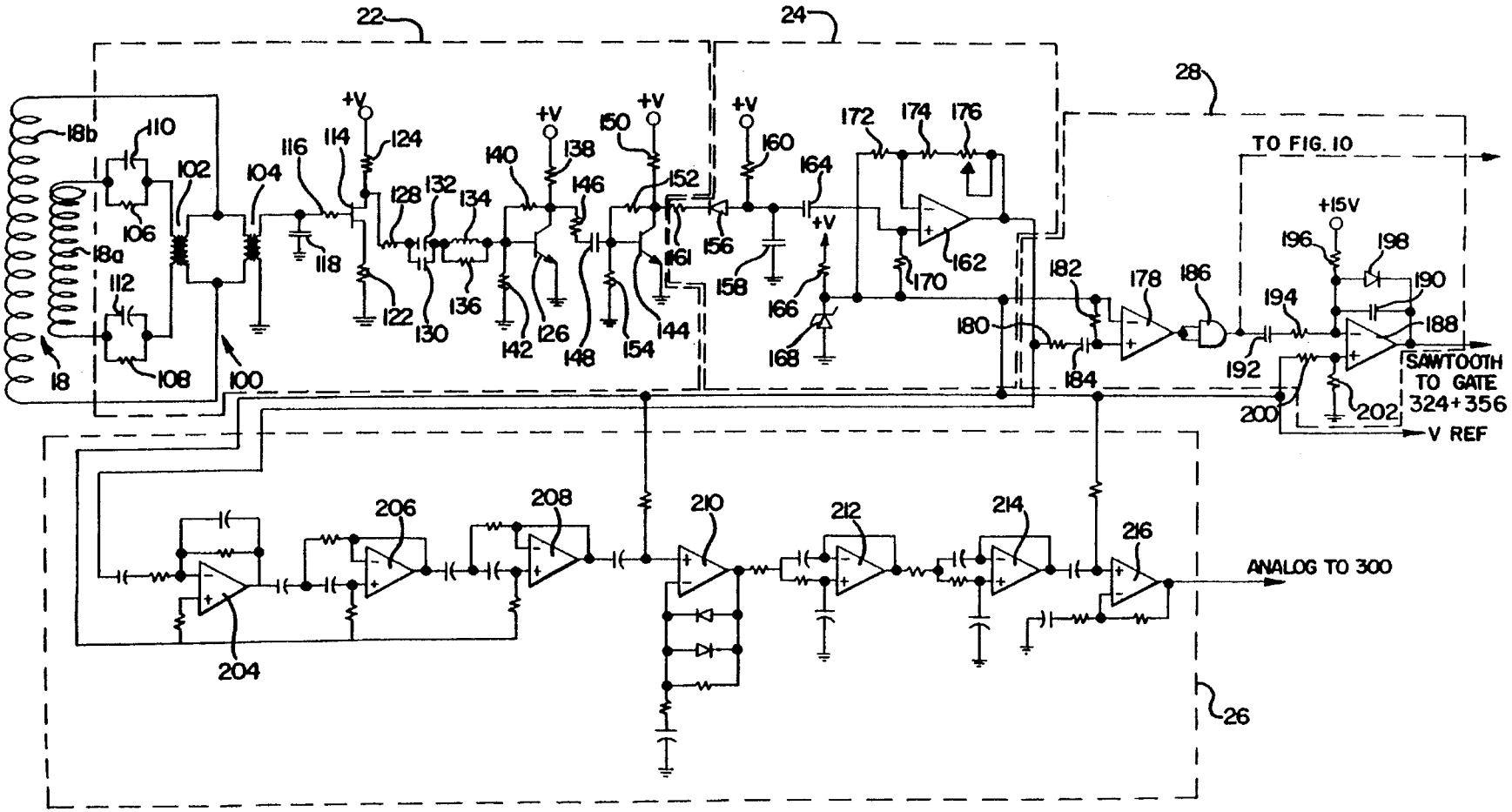
FIGS. 2 and 3 are schematic circuit diagrams of the circuitry shown in block diagram form in FIG. 1.

Referring now to FIG. 2, the RF filter and gain circuit 22, the envelope detector and audio frequency gain circuit 24, the bandpass filter and gain 26 and the sawtooth generator 28 are shown in greater detail. As is shown in FIG. 2, the RF filter and gain circuit 22 is connected to the antenna 18 which in the illustrated embodiment comprises a pair of antenna loops **18*a* and 18*b* by means of a coupling network 100. The function of the coupling network 100 is to provide antenna matching and to provide a 90° phase shift between the loops 18*a* and 18*b* which may be, for example, two loops of an antenna of the type described in U.S. Pat. No. 4,872,018. In the illustrated embodiment, the coupling network 100 comprises a pair of transformers 102 and 104 that provide the desired impedance matching through the loops 18*a* and 18*b*, and a 90° phase shift network comprising resistors 106 and 108 and capacitors 110 and 112. A field effect transistor 114 serves as an RF amplifier, and the output of the transformer 104 is coupled to the gate of the field effect transistor 114 by a resistor 116 and a capacitor 118. In the illustrated embodiment, a field effect transistor is used as the RF amplifier because of its low noise figure and good intermodulation rejection characteristics relative to those of a bipolar transistor. The field effect transistor 114 has a source resistor 122 and a drain resistor 124 and its drain terminal is coupled to the base of a transistor 126 by a network comprising a coupling resistor 128, a fixed capacitor 130, a variable capacitor 132, an inductor 134 and a resistor 136. The aforementioned series L-C coupling network determines the radio frequency to which the receiver is tuned and is adjustable by means of the capacitor 132. A resistor 138 serves as a collector resistor for the transistor 126 and a pair of resistors 140 and 142 serve as biasing resistors. A transistor 144 is coupled to the collector of the transistor 126 by a resistor 146 and a capacitor 148 and provides additional radio frequency gain. A resistor 150 serves as a collector resistor for the transistor 144 and a pair of resistors 152 and 154 serve as biasing resistors. The RF filter and gain circuit 22 has an overall phase shift of approximately 180° to reduce the possibility of oscillation. Negative feedback is used around the transistors 140 and 144** to obtain a low input impedance to reduce the pick up of spurious signals.

The output of the radio frequency filter and gain circuit 22, taken at the collector of the transistor 144, is a radio frequency signal that has a frequency equal to the instantaneous frequency of the swept signal transmitted by the transmitter 12 and an amplitude that has been amplitude modulated by the coupling network 100 as the transmitter is swept over its range of frequencies. The coupling network 100 and a similar coupling network 13 between the transmitter and transmitting antenna attenuate the higher frequencies of the sweep range. Thus, the received signal is amplitude modulated at the sweep frequency and has its peaks at low frequency excursions of the sweep and its valleys at the high frequency excursions. The modulated envelope at the output of the transistor 144 is also slightly distorted by the presence of any tag in the vicinity of the antenna 18 as the transmitter frequency is swept through the resonant frequency of the tag.

The amplitude modulation of the output signal from the transistor 144 is recovered by the envelope detector and gain circuit 24. The output of the transistor 144 is applied to an envelope detector comprising a diode 156, a capacitor 158 and a resistor 160 via a resistor 161. The diode 156 is forward biased so that the signal applied to the diode 156 need not exceed its forward diode drop of approximately 0.7 volts before detection can take place in order to improve sensitivity of the detector. The signal at the junction of the diode 156, capacitor 158 and resistor 160 is an audio frequency signal that is representative of the envelope of the radio frequency signal at the collector of the transistor 144. The detected audio signal is coupled via a coupling capacitor 164 to an amplifier 162 for amplification thereby. A resistor 166 and a Zener diode 168 provide a reference voltage to the amplifier 162 via a resistor 170. The reference voltage is also applied to other portions of the circuit. A pair of resistors 172 and 174 and a potentiometer 176 form part of a feedback loop around the amplifier 162 and are used to control the gain of the amplifier 162.

The output of the amplifier 162 is connected to synchronizing circuitry and to signal processing circuitry of the receiver. The amplitude modulation introduced by the antenna coupling network provides synchronizing information to the receiver and the signals produced by a tag in the vicinity are detected by this processing circuitry. The synchronizing circuitry includes a comparator 178 within the sawtooth generator 28 that is connected to the output of the amplifier 162 by a coupling network including a pair of resistors 180 and 182 and a capacitor 184. The coupling network operates as a differentiating network so that the comparator 178 changes state each time the slope of the signal from the amplifier 162 changes direction. Thus, the output of the comparator 178 changes state each time the swept RF signal changes direction, i.e., at the peaks and valleys of the modulation introduced by the antenna coupling network. Consequently, the output of the comparator 178 is a square wave which defines the maximum and minimum frequency excursions of the swept RF signal.

The output of the comparator 178 is buffered by a gate 186 and applied to an integrator comprising an amplifier 188, feedback circuitry including a pair of capacitors 190 and 192, a pair of resistors 194 and 196 and a diode 198. The integrating circuit serves to integrate a square wave signal from the gate 186 whose transitions occur at the extreme excursions of the sweep of the transmitted signal. Consequently, the output of the amplifier 188 is a triangular wave signal having peaks and valleys corresponding to the extreme excursions of the radio frequency signal and linear slopes connecting the peaks and valleys. This triangular wave signal is subsequently used to provide synchronization for the tag detection circuitry. Although a triangular or sawtooth wave signal is particularly convenient for use in the synchronization circuits because its amplitude is linearly related to the instantaneous frequency of the transmitter, thus making it relatively easy to ascertain the instantaneous frequency, a periodic waveform having other wave shapes may be used. A pair of resistors 200 and 202 provide bias for the amplifier 188.

The output of the amplifier 162 also contains the tag signal when a tag is present in the detection zone. However, the amplitude of the tag signal is generally substantially smaller than the amplitude of the amplitude modulation introduced by the antenna coupling networks as the transmitter is swept over its frequency range. However, while the amplitude of the tag signal is considerably smaller than the amplitude introduced by the sweep of the transmitter, the frequency components of the tag signal are considerably different than those of the sweep frequency. For example, while the sweep frequency is on the order of 178 Hz, the frequency components of the tag signal are centered around approximately 4 kHz. Consequently, by passing the detected signal from the amplifier 162 through a bandpass filter centered about 4 kHz, most extraneous signals, including the sweep signal are substantially attenuated, and the detectability of the tag signal is enhanced. The filtering is accomplished by the bandpass filter and gain circuit 26 that filters out extraneous components of the detected signal before the detected signal is applied to the processing circuitry that detects the presence of a tag.

In the embodiment illustrated in FIG. 2, the bandpass filter is fabricated as a high pass and a low pass filter connected in tandem. Three amplifiers 204, 206 and 208 and associated components operate as a low pass filter that attenuates frequencies below 4 kHz including the 178 Hz sweep frequency. An amplifier 210 and associated circuitry provide gain to the low pass filtered signal and three amplifiers 212, 214 and 216 and associated components serve as a high pass filter to attenuate frequencies above 4 kHz. Thus, the combination of the high pass and low pass filters serves as a bandpass filter centered around 4 kHz to permit the passage of the tag signal and to attenuate other frequencies. Because high pass and low pass filters of the type forming the bandpass filter 26 are well known, and because various types of filters may be used to provide the desired bandpass filter characteristics, the circuitry of the bandpass filter and gain circuit 26 will not be discussed in detail.

Figure 3:
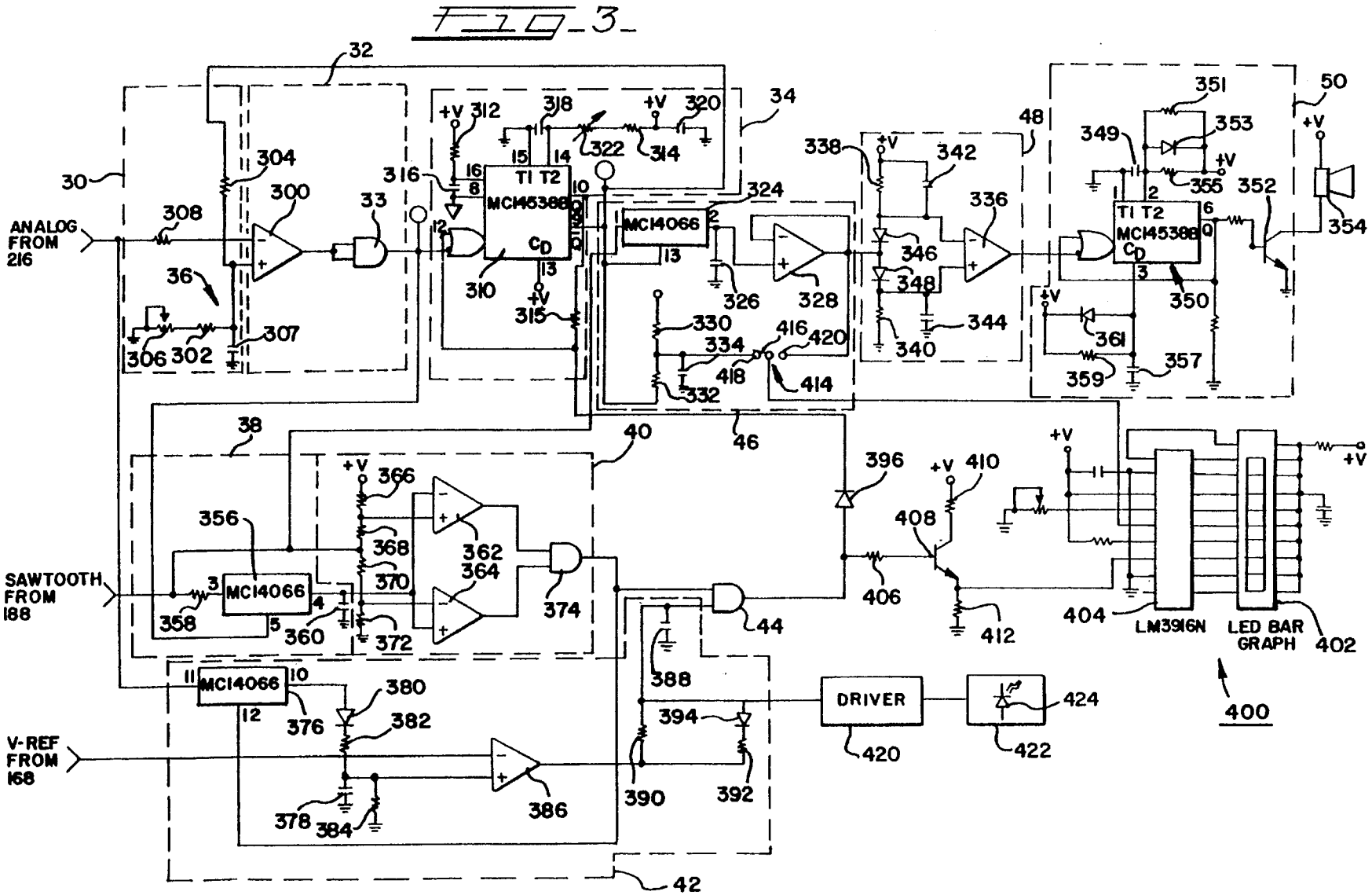

Referring now to FIG. 3, the adaptive threshold circuit 30 feeds a comparator 300 that has a threshold that is determined by a pair of resistors 302 and 304 and a variable resistor 306 as well as a feedback signal received from the processor 34. The feedback signal from the processor 34 is integrated by the resistor 304 and a capacitor 307. The comparator 300 receives the filtered analog signal from the amplifier 216 of the bandpass filter 26 via a resistor 308 and compares it with the variable threshold signal to provide an output from the pulse detector 32, which comprises a comparator 300 and a gate 33 in FIG. 3, whenever the signal received from the amplifier 216 exceeds the variable threshold. The output of the gate 33 is applied to the processor 34 which includes a monostable multivibrator 310 and associated circuitry including resistors 312, 314 and 315, capacitors 316, 318 and 320 and a variable resistor 322. The variable resistor 322 cooperates with the resistor 314 and the capacitor 318 to determine how long the multivibrator remains triggered following the detection of a pulse by the pulse detector 32. Typically, the timing is selected so that once the multivibrator 310 is triggered, it is non-responsive to further signals from the gate 32' for a time period corresponding to nearly one sweep of the sweep frequency generator 14. A monostable multivibrator suitable for use as the multivibrator 310 is an MC14538B multivibrator manufactured by Motorola, Inc., but others can be used.

The feedback signal for a variable threshold circuit is obtained from the $\bar{Q}$ output of the multivibrator 310. As long as the multivibrator 310 is not triggered, the $\bar{Q}$ output is in its high state, and if the multivibrator 310 remains untriggered for a sufficiently long time, the capacitor 307 will charge to a value determined by the high state value of the $\bar{Q}$ output divided by the voltage divider action of the resistors 302, 304 and 306. Under these conditions, the adaptive threshold voltage is close to the analog voltage received from the amplifier 216 and maximum sensitivity to perturbations in the analog signal is achieved. However, each time the multivibrator 310 is triggered, the $\bar{Q}$ output goes low for a period of time corresponding to approximately one sweep period of the sweep signal. This results in a reduction in the integrated voltage appearing across the capacitor 307, and moves the threshold voltage away from the analog voltage thereby desensitizing the system. The more often the multivibrator 310 is triggered, the more the threshold voltage is moved away from the analog voltage. This results in a desensitizing of the system in noisy environments to a point where the threshold is moved away from the analog signal by an amount sufficient to prevent the peaks of the analog signal from crossing the threshold which reduces the possibility of a false alarm being generated by a spurious signal.

The output of the processor 34 is coupled to the processor sample and hold circuit 46 that includes a sampling gate 324 that samples the sawtooth signal from the amplifier 188 (FIG. 2) whenever the $\bar{Q}$ output from the multivibrator 310 is high and applies the sampled signal to a capacitor 326. A circuit suitable for use as the sampling gate 324 and other sampling gates used in the illustrated embodiment is a type MC14066B analog switch manufactured by Motorola, Inc., but others may be used. The sampled signal on the capacitor 326 is applied to a buffer 328 prior to application to the steady state discriminator 48. The signal from the multivibrator 310 is also divided down by a pair of resistors 330 and 332 and filtered by a capacitor 334 to provide a signal usable by a diagnostic display circuit that will be discussed in a subsequent portion of the application.

The steady state discriminator 48 includes a comparator 336, a pair of resistors 338 and 340, a pair of capacitors 342 and 344 and a pair of diodes 346 and 348. The purpose of the steady state discriminator 48 is to detect a lack of changing conditions at the output of the buffer 328. The lack of a changing condition at the output of the buffer 328 indicates that a synchronous signal such as a tag signal is being detected and is indicative of an alarm condition. When the output from the buffer 328 is a steady state output, the comparator 336 is biased effectively by a voltage divider formed by the resistor 338, the diodes 346 and 348 and the resistor 340. Under these conditions, the voltage applied to the negative input of the comparator 336 is above the voltage applied to the positive input and the comparator is in its cut-off (low) state. However, if the output of the buffer 328 contains fluctuations, those fluctuations are rectified by the diodes 346 and 348. Such fluctuations result from the sampling gate 324 causing the voltage on capacitor 326 to follow the triangle waveform at the output of amplifier 188 for a relatively wide portion of the sweep period. This causes the capacitor 342 to be negatively charged and the capacitor 344 to be positively charged thereby making the positive input to the comparator 336 positive with respect to the negative input and causing the comparator 336 output to be in the high state. Thus, the low-going output of the comparator 336 is indicative of the detection of a tag.

The output of the steady state discriminator 48 is applied to the alarm timer 50 that comprises a monostable multivibrator 350 and a transistor 352 and associated circuitry that are triggered by the comparator 336 when the output of the comparator 336 is indicative of the presence of a steady state condition at the output of the processor sample and hold 46 and, particularly the output of the buffer 328. The monostable multivibrator 350 together with its associated components operates as a timer that energizes the transistor 352 and causes the transistor 352 to energize an annunciator such as a beeper, siren or a horn 354 for a predetermined amount of time. A circuit comprising a capacitor 349, resistors 351 and 355 and a diode 353 determine the length of time that the alarm is sounded. A circuit including a capacitor 357, a resistor 359 and a diode 361 inhibits the multivibrator 350 when power is initially applied to the system to prevent an alarm from being generated during power up or during a power drop out. Inasmuch as any suitable timer may be used as the timer 50, the specific details of the circuitry of the timer 50 will not be discussed.

The output of the pulse detector 32 controls the operation of the detector sample and hold circuit 38 which includes a sampling gate 356, a resistor 358 and e capacitor 360. The sawtooth waveform from the amplifier 188 is applied to the sampling gate 356 via the resistor 358 and the sawtooth waveform is sampled and applied to the capacitor 360 for as long as the pulse detector 32 provides a high state signal indicating that a pulse is present, i.e., that the analog signal has exceeded the threshold voltage. Thus, the capacitor 360 charges to a voltage that corresponds to points on the sawtooth waveform that are indicative of the frequency of a disturbance signal. The notch pulse generator circuit 40 consists of comparators 362 and 364, AND gate 374 and a resistive divider network described hereinafter. The output of the sampling gate 356 is applied to the negative input of a comparator 362 and to the positive input of a comparator 364. Comparators 362 and 364 form a "window" comparator in conjunction with AND gate 374, with an upper and lower voltage threshold. The output of gate 374 will be high whenever the voltage on capacitor 360 is between these two thresholds, as next described. Comparators 362 and 364 receive the sawtooth signal from the amplifier 188 via a resistive divider network comprising resistors 366, 368, 370 and 372. The function of the resistive divider is to provide a DC offset to the sawtooth waveform so that the sawtooth waveform appearing at the junction of the resistors 366 and 368 and applied to the positive input of the comparator 362 has a positive offset with respect to the sawtooth waveform appearing at the junction of the resistors 370 and 372 and applied to the negative input of comparator 364. Thus, when the sampled voltage on the capacitor 360 is below the sawtooth voltage appearing at the junction of the resistors 366 and 368, the comparator 362 will provide a high state output. Similarly, when the voltage across the capacitor 360 is above the sawtooth voltage appearing at the junction of the resistors 370 and 372, the comparator 364 will provide a high state output. The outputs of the comparators 362 and 364 are applied to an AND gate 374 which provides a high state output only when the inputs from the comparators 362 and 364 applied thereto are both high. This condition only occurs when the amplitude of the voltage across the capacitor 360 is greater than the amplitude of the sawtooth voltage appearing at the junction of the resistors 370 and 372 and below the voltage of the waveform appearing at the junction of the resistors 366 and 368. The output pulse from the gate 374 is referred to as a notch pulse and will be described in greater detail in a subsequent portion of the application. It should be noted that resistor 358 and capacitor 360 form a slow integrator so that extraneous noise pulses do not pull the notch pulse away from a steady interference signal.

The output of the notch pulse generator 40 (gate 374) controls the operation of another sampling gate 376. Within the notch delay circuit 42, the gate 376 samples the analog signal from the amplifier 216 of the bandpass filter and gain circuit 26. The output of the sampling gate 376 is applied to a capacitor 378 via a diode 380 and a resistive dividing network comprising a pair of resistors 382 and 384. The sampling gate 376 samples the analog voltage from the amplifier 216 whenever a notch pulse is received from the gate 374 and applies the sampled voltage to the capacitor 378 via the diode 380 and the resistors 382 and 384. The sampled voltage appearing across the capacitor 378 is applied to a comparator 386 that provides a high state output when ever the sampled voltage exceeds a fixed reference voltage, such as the fixed voltage appearing across the Zener diode 168 (FIG. 2). The output of the comparator 386 is applied to a slow attack, fast decay circuit comprising a capacitor 388, a pair of resistors 390 and 392 and a diode 394. The slow attack, fast decay circuit serves to charge the capacitor 388 slowly through the resistor 390 when the output of the comparator 386 goes from its low state to its high state, and to discharge the capacitor 388 rapidly through the diode 394 and the resistor 392, and also the resistor 390 when the output of the comparator 386 goes from its high state to its low state.

The notch pulse generator 40 provides two notch pulses during each sweep period and the notch pulse delay samples and integrates the analog signal and provides a high state output when the integrated analog signal exceeds the reference voltage. The output pulses from the notch pulse generator 40 are applied to the AND gate 44 as is the output of the notch delay circuit 42. Thus, the output of the AND gate 44 goes high each time a notch pulse is generated by the notch pulse generator 40 provided that the voltage across the capacitor 388 of the slow attack, fast decay network of the notch delay 42 is also high. Thus, a notch pulse is generated at the output of the gate 44 which is coincident in time with the passage of the transmitter sweep through a frequency at which an interference signal persists for a sufficiently long time interval defined by the notch pulse delay circuit 42. The notch pulses from the AND gate 44 are applied to the multivibrator 310 via a diode 396 and serve to inhibit the triggering of the multivibrator 310 during the duration of a notch pulse. Thus, when notch pulses are present, the pulses from the pulse detector 32 are inhibited from triggering the multivibrator 310. Consequently, the "notched out pulses" are not transmitted to the processor sample and hold 46 and consequently, cannot generate an alarm. In addition, since the "notched out" pulses do not trigger the multivibrator 310, they have no effect on the $\bar{Q}$ output of the multivibrator 310, and hence do not alter the adaptive threshold signal 30. As a result, once pulses resulting from an extraneous carrier or a structural resonance have been "notched out", the adaptive threshold is again moved close to the amplitude of the analog signal, and full sensitivity to true tag signals is maintained at frequencies other than those blanked by the notch even in the presence of an interfering carrier or structural resonance. The detector sample and hold 38, the notch pulse generator 40 and the notch delay sample and hold 42 work together to (1) identify that a signal is present, (2) seek out the frequency of the signal and (3) determine if it is an unwanted signal based on its duration and, if so, inhibit detection of signals at that frequency, for as long as they persist. When installing and servicing electronic article surveillance systems, it is desirable to provide the installer or service person information regarding the environment in which the system is installed. In particular, it is desirable to provide the installer with information relating to the frequency of any interfering carrier or structural resonance and how likely such interference signals are to cause the system to false alarm, based on the relative noise level. Thus, in accordance with another important aspect of the present invention, there is provided a diagnostic display system generally designated by the reference numeral 400. The diagnostic display 400 comprises a light emitting diode bar graph display 402 that is driven by a display driver circuit 404. A type LM3916 A/D display driver circuit manufactured by National Semiconductor may be used as the display driver circuit 402. The bar graph display 402 and the driver 404 are responsive to the amplitude of an analog signal applied to the driver 404 to provide a display on the bar graph 402 that is proportional to the amplitude of the analog voltage applied. The display 400 is disabled by notch pulses provided to the driver 404 from the gate 44 via a resistor 406 and a buffer comprising a transistor 408 and resistors 410 and 412. Thus, a portion of the display 400 is blanked out during the occurrence of a notch pulse.

The level or the frequency of an interfering signal may be ascertained by monitoring either the processor 34 or the processor sample and hold circuit 46. A switch 414 that has an armature 416 that is movable between an amplitude monitoring pole 418 and a frequency monitoring pole 420 is used to determine whether amplitude or frequency is to be monitored. In the amplitude monitoring position, the armature 416 is connected to the amplitude monitoring pole 418 which serves to monitor the $\bar{Q}$ output of the multivibrator 310 which has been scaled by the resistors 330 and 332 and integrated by the capacitor 334. Since the voltage across the capacitor 334 is proportional to an average value of the $\bar{Q}$ output of the multivibrator (as is the voltage across the capacitor 307 of the variable threshold circuit), the voltage across the capacitor 334 is proportional to the variable threshold voltage and is indicative of the magnitude of any synchronously occurring pulses detected by the system. This voltage is applied to the driver 404 and serves to illuminate the bar graph 402 in proportion to the magnitude of the adaptive threshold signal, thus providing an indication of how synchronous an interfering signal or noise is with the transmitter sweep rate. Thus, the installer can quickly assess the likelihood of false alarms based on the level of synchronous noise displayed on LED bar graph 402.

In the frequency mode of display of the diagnostic display 400, the armature 416 of the switch 414 is connected to the pole 420 to monitor the output of the buffer 328 of the processor sample and hold circuit 46. When no synchronously detected signal is present, the output of the buffer 328 follows the sawtooth waveform and, consequently, the light emitting diodes of LED bar graph 402 are sequentially illuminated as the sampled sawtooth signal moves up and down in amplitude. This gives an illusion that all of the light emitting diodes of the bar graph 402 are simultaneously lighted. However, when a steady state condition indicative of a tag or other pseudo-synchronous or synchronous signal such as a carrier or resonance is present, the voltage at the output of the buffer 328 is equal to a voltage within the sweep range of the sawtooth signal that is indicative of the particular frequency of the detected signal. When this signal is applied to the diagnostic display 400, one or more segments of the bar graph display is illuminated which approximately corresponds to a voltage point on the triangle waveform, and relates to the frequency band within the transmitter sweep range where the synchronous signal occurs. However, when the synchronous signal is notched out by the system, the notch pulse disables the segments of the display 400 that correspond to the frequency band of the notched out signal. Thus, the light emitting diodes corresponding to the notched out frequency will not be illuminated and be illustrative of the frequency of the interfering signal.

The appearance of the bar graph display is useful in providing information to the installer or service person about the environment in which the system is installed. For example, since the display provides a display of the synchronocity of signals in the environment, flickering of a large number of segments provides an indication of the presence of random noise. The flickering of two adjacent segments illustrates the presence of an interfering carrier. The illumination of a single segment illustrates the presence of a structural resonance, and the illumination of multiple spaced single elements illustrates the presence of multiple resonances. Thus, the display serves as an important diagnostic tool.

The system is also provided with an indicator to provide an indication to the user that an interfering signal such as a carrier or structural resonance that has a large enough magnitude and has persisted for a sufficiently long time period to have been notched out is present. This function is provided by a driver 420 and an indicator light 422 which may contain a light emitting diode 424. The driver 420 monitors the output of the notch delay sample and hold circuit that is applied to the gate 44, and energizes the indicator light 422 when the gate 44 is enabled. Thus, the indicator light 422 provides an indication to the user that interference of sufficient magnitude and duration to activate the notch circuitry is present to warn him of potential interference problems.

Figure 4:
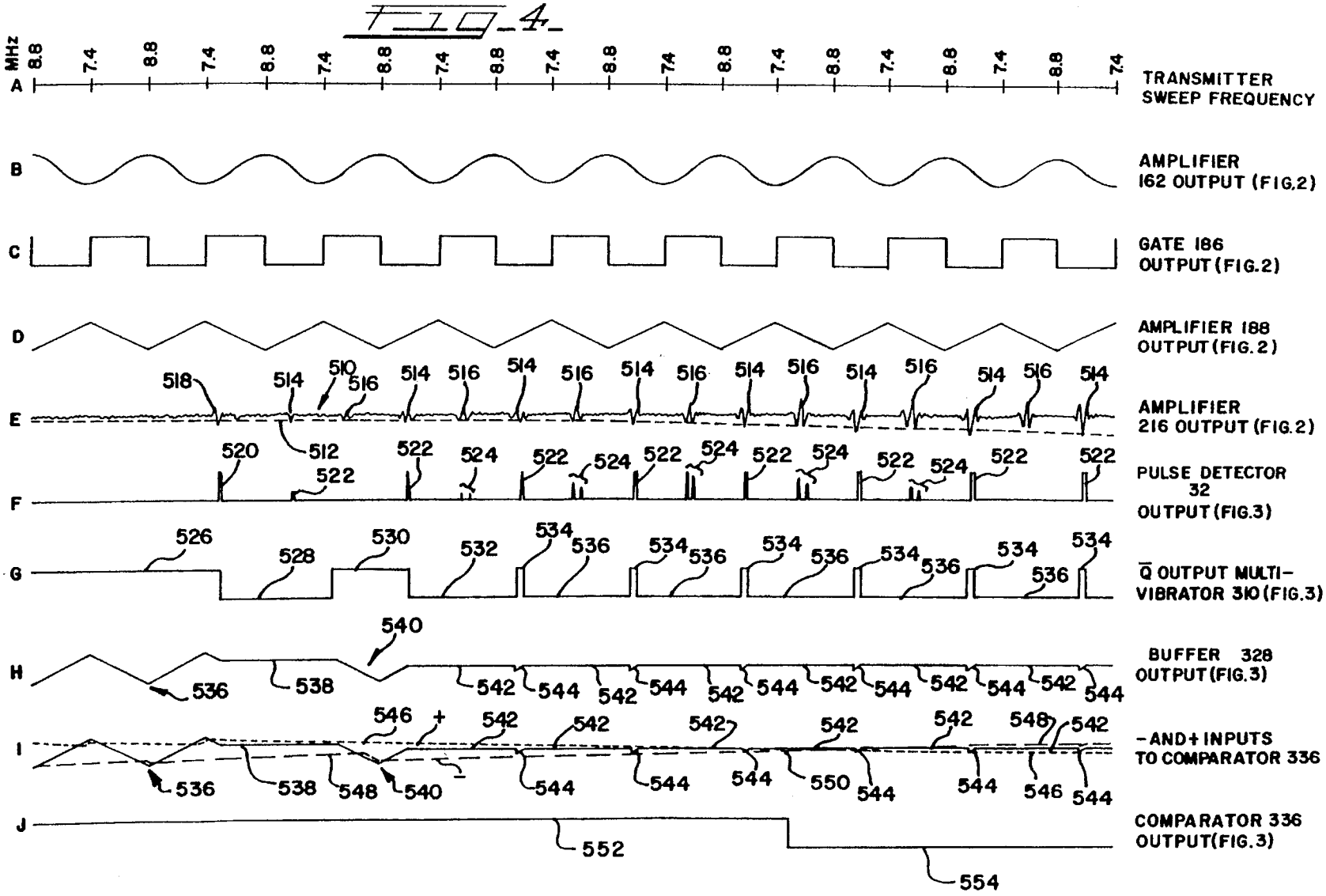
FIGS. 4 and 5 illustrate the waveforms of the signals present at various points of the circuits ofFIGS. 1–3 when a tag or an interfering signal is detected by the system.

The operation of the circuit according to the invention can be better understood by studying the signal waveforms at various points on the circuit diagrams of FIGS. 2 and 3. Referring now to FIG. 4, there is shown a series of waveforms that illustrate the detection of a tag. FIGS. 4A–4D illustrate how synchronizing information for the system is obtained. FIG. 4A represents the range of frequencies of the swept frequency signal generated by the transmitter 12 and applied to the transmitting antenna 16. The swept frequency signal illustrated in FIG. 4A is swept over a range of frequencies between 7.4 mHz and 8.8 mHz. FIG. 4B illustrates the output of the envelope detector and gain circuit 24, more specifically, the signal present at the output of the amplifier 162 of FIG. 2. The waveform of FIG. 4B is essentially a sine wave having its peaks at 8.8 mHz and its valleys at 7.4 mHz. As previously stated, the sine wave is introduced by the antenna matching networks in the transmitter and receiver that attenuate high frequencies more than low frequencies and thus serve to amplitude modulate the envelope of the received radio frequency signal at the sweep rate. FIG. 4B shows the demodulated envelope. Although the amplitude of the modulated radio frequency signal is larger at low frequencies than at high frequencies, because of the polarity of the diode 156, the demodulated signal of FIG. 4B has a higher amplitude at high frequencies than at low frequencies. Also, a tag signal is not readily apparent in the waveform of FIG. 4B because the amplitude modulation introduced by the antenna matching networks is substantially larger than the tag signal.

The waveform of FIG. 4B provides an indication of the high and low limits of the sweep and may be used to synchronize the system, as could any periodic waveform having the correct periodicity. However, it is desirable to have a waveform that varies linearly between the limits of the sweep so that an indication of the instantaneous frequency of the swept signal between limits may be readily ascertained. In the present embodiment, such a linear or sawtooth waveform is generated in two steps. First, a square wave, as illustrated in FIG. 4C, is generated by the comparator 178 and gate 186 which, because of the differentiating action of the capacitor 184, generate a transition each time the slope of the waveform of FIG. 4B changes. When the slope of the waveform of FIG. 4B goes from a negative slope to a positive slope, the waveform of FIG. 4C switches from a low state to a high state, and when the slope of the waveform of FIG. 4B goes from a positive to a negative slope, the waveform of FIG. 4C goes from a high state to a low state. The waveform of FIG. 4C is then integrated by the integrator including the amplifier 188 and associated components to provide the triangular waveform of FIG. 4D. The triangular waveform of FIG. 4D is sampled by the various sample and hold circuits such as the detector sample and hold circuit 38 and the processor sample and hold circuit 46 of the system to provide information relating to the synchronism and frequencies of signals detected by the system.

FIGS. 4E through 4J illustrate the operation of the tag signal processing channel. The waveform of FIG. 4E illustrates the magnitude of the analog signal from the bandpass filter and gain circuit 26 relative to the magnitude of the adaptive threshold of the adaptive threshold circuit 30. The analog signal is illustrated as a solid line 510 and the position of the adaptive threshold is illustrated by a dashed line 512. The analog signal 510 has been filtered by the bandpass circuitry contained in the bandpass filter and gain circuit 26 to remove frequencies outside the band of frequencies generated by a tag. Consequently, the sinusoidal component at the sweep frequency (FIG. 4B) has been removed and the tag signals are now more readily apparent, as are signals other than tag signals that fall within the pass band of the bandpass filter and gain circuit 26.

FIG. 4E illustrates the detected analog signal produced by a tag as it enters the interrogation field between the antennas 16 and 18. A tag signal is produced each time the instantaneous frequency of the transmitted swept signal coincides with the resonant frequency of the tag. This occurs twice during each sweep cycle, once during the increasing frequency sweep and once during the decreasing frequency sweep. As is illustrated in FIG. 4E, the resonant tag entering the field has a resonant frequency of approximately 8.1 mHz, about midway between the extremes of the excursions of the sweep between 7.4 mHz and 8.8 mHz. As is illustrated in FIG. 4E, the tag produces two tag signals during each sweep, a tag signal 514 that occurs during the decreasing frequency portion of the sweep and a tag signal 516 that occurs during each increasing frequency portion of the sweep. In addition, the waveform of FIG. 4E contains a noise signal 518 that occurred before the tag entered the interrogation field and was not produced by the tag. The noise signal 518 will be used to illustrate how the system discriminates between noise signals and valid tag signals.

The pulse detector 32 monitors the waveform 510 and provides an output each time the signal 510 exceeds the threshold 512. The output of the pulse detector 32 is illustrated in FIG. 4F. As is apparent from FIG. 4F, both the noise burst and the tag signals cause a detector output pulse to be generated. The noise burst 518 causes a detector output pulse 520 to be generated when its amplitude exceeds the threshold 512. Similarly, the tag signals 514 generate output pulses 522 when the threshold 512 is exceeded, and the tag pulses 516 generate detector output pulses 524 when the threshold is exceeded.

One of the characteristics of a valid tag signal is that it is in phase and frequency synchronism with the sweep frequency of the transmitter. Thus, if a valid tag pulse is detected during one sweep cycle, the next tag pulse whose occurrence can be easily predicted must occur at the same point during the next sweep cycle, and any signals occurring at other points of the sweep cycle may be ignored. The prediction of the time of occurrence of the next valid tag pulse during the next sweep is accomplished by the processor 34 which includes a timer that utilizes the multivibrator 310 to render the system non-responsive to signals occurring in less than one sweep period following the detection of a pulse. The output of the processor 34, and more particularly the $\bar{Q}$ output of the multivibrator 310 (FIG. 3), is illustrated in FIG. 4G. In the absence of a detected signal, the $\bar{Q}$ output of the multivibrator 310 is high until a detected pulse is received. As is illustrated in FIG. 4, when the pulse 520 is generated (FIG. 4F), the $\bar{Q}$ output of the multivibrator 310 goes from its high state 526 to its low state 528. The timing is set so that the output remains in its low state 528 for a time period slightly shorter than the sweep period, for example, for a time period equal to approximately 93–99% of the sweep time. During the time that the output of the multivibrator 310 remains in its low state 528, the multivibrator 310 cannot be retriggered and, consequently, any pulses detected during that time interval will be ignored by the system. Once the multivibrator has timed out, the $\bar{Q}$ output returns to its high state, as illustrated by a portion 530 of the waveform, until it is retriggered by the next received pulse.

The pulse 520 that caused the output of the processor 34 to go from its high state 526 to its low state 528 was not a valid tag pulse. Consequently, when the output of the processor 34 returned to its high state at point 530, no pulse occurred immediately following the transition to the high state 530 as would have been the case if the pulse 520 were a detected tag pulse. Thus, the $\bar{Q}$ output of the multivibrator 310 remained in its high state 530 until the occurrence of the next pulse 522, which is a valid tag pulse. Upon the occurrence of the trailing edge of pulse 522, the $\bar{Q}$ output of the multivibrator 310 changes to its low state for a time period 532 that is slightly shorter than the sweep time of the transmitter sweep frequency. After the multivibrator times out, it again returns to its high state at a point 534. However, another tag pulse 522 is almost immediately detected, and the $\bar{Q}$ output is again returned to its low state for a time interval 536. After the time interval 536, the multivibrator times out, but is immediately retriggered by another pulse 522 and the cycle is repeated as long as the tag is present to provide a series of narrow pulses 534 that are separated by a series of time intervals 536 that are on the order of one sweep period long or until the notch circuitry (38, 40, 42) is engaged to inhibit the triggering of the processor 34, or until the adaptive threshold 30 has had time to increase the detection threshold voltage of the pulse detector 32 beyond the level of continuous pulse detection. Any signals occurring during the time periods 536 are ignored and the pulses 534 are synchronized to the pulses 522, and consequently to the, sweep frequency of the transmitter.

The processor sample and hold circuit 46 samples the output of the sawtooth generator 28 under the control of control pulses from the processor 34. The output of the processor sample and hold circuit 46, more particularly the output of the buffer 328 (FIG. 3), is shown in FIG. 4H. As long as the $\bar{Q}$ output of the multivibrator 310 is high, the sampling gate 324 will be closed (shorted) and the output of the processor sample and hold circuit 46 will follow the sawtooth waveform from the sawtooth generator 28 (FIG. 5D). Thus, when the $\bar{Q}$ output of the multivibrator 310 is high, such as during the time interval 526 (FIG. 4G), the output of the processor sample and hold 46 will be a replica of the sawtooth sweep as illustrated by the waveform 536 (FIG. 4H). When the $\bar{Q}$ output goes low, as during the low state time interval 528, the processor sample and hold circuit 46 samples and holds the instantaneous value of the sawtooth sweep that was present when the transition to the low state 528 was made, as is illustrated by the area 538. When the $\bar{Q}$ output reverts to its high state 530, the processor sample and hold output again follows the sawtooth waveform as illustrated at 540.

As long as no valid tag signal is present, the $\bar{Q}$ output of the multivibrator 310 remains high for relatively long time intervals. During these time intervals, the output of the processor sample and hold circuit 46 follows the sawtooth waveform. Consequently, the output of the processor sample and hold circuit 46 has relatively large excursions when no valid tag signal is present. However, once a valid tag signal has been detected, the $\bar{Q}$ output of the multivibrator remains high for only relatively short intervals of time which are synchronized to the transmitter sweep period, for example, during the time intervals 534 because it is being constantly retriggered by tag pulses. During most of the time, the $\bar{Q}$ output will be at its low state as illustrated by the areas 536. During these times, the output of the processor sample and hold circuit will remain relatively constant as illustrated by the areas 542 (FIG. 4H). Only slight perturbations 544 will occur in the output of the processor sample and hold circuit during the time intervals of the pulses 534 (FIG. 4G). Consequently, when a phase synchronous signal, such as a tag signal, is being detected, the output of the processor sample and hold circuit will remain relatively constant, thus providing a detectable indication that a tag has been detected.

The output from the processor sample and hold circuit 46 is applied to the steady state discriminator to determine whether a steady state condition indicative of the presence of a tag exists. The signal from the buffer 328 (FIG. 3) of the processor sample and hold circuit 46 is applied to the rectifier circuit comprising diodes the 346 and 348, the resistors 338 and 340, and the capacitors 342 and 344. As long as no tag is present, and the output signal from the buffer 328 swings appreciably, the signal from the buffer 328 will be rectified by the diodes 346 and 348 so that the negative input to the comparator 336 will be negative relative to the positive input, thus causing the output of the comparator 336 to be high 552. If the output of the processor sample and hold circuit 46 remains in a relatively steady state, very little AC signal will be available for rectification by the diodes 346 and 348 in the steady state discriminator 48. Consequently, the polarity of the signals applied to the comparator 336 will be reversed by the voltage divider action of the resistors 338 and 340 and the diodes 346 and 348, with the signal applied to the negative input of the comparator 336 being positive relative to the signal applied to the positive input. When the polarity reversal occurs, the output of the comparator 336 will change state to a low state 554.

The operation of the steady state discriminator 48 is illustrated in FIG. 4I. FIG. 4I illustrates the magnitude of a voltage 546 applied to the positive input of the comparator 336 relative to the amplitude of a voltage 548 applied to the negative input of the comparator 336 in the presence of the signal from the processor sample and hold circuit 46 illustrated in FIG. 4H. When the signal from the processor sample and hold circuit 46 has relatively large excursions, as is illustrated in the region between 536 and 538, the voltage 546 remains above the voltage 548. When the output from the processor sample and hold circuit 46 is relatively quiescent, as is illustrated in area 538, the voltages 546 and 548 tend to converge as capacitors 342 and 344 begin to discharge. If the output from the processor sample and hold circuit 46 remains quiescent for a long period of the time, as is illustrated by the region 542, the voltages 546 and 548 will converge until they cross over at a point 550 where the voltage 548 exceeds the voltage 546. When the cross-over occurs, the output of the comparator 336 (FIG. 4J) changes state from a high state 552 to a low state 554 to indicate that a tag has been detected and to actuate the alarm.

Figure 5:
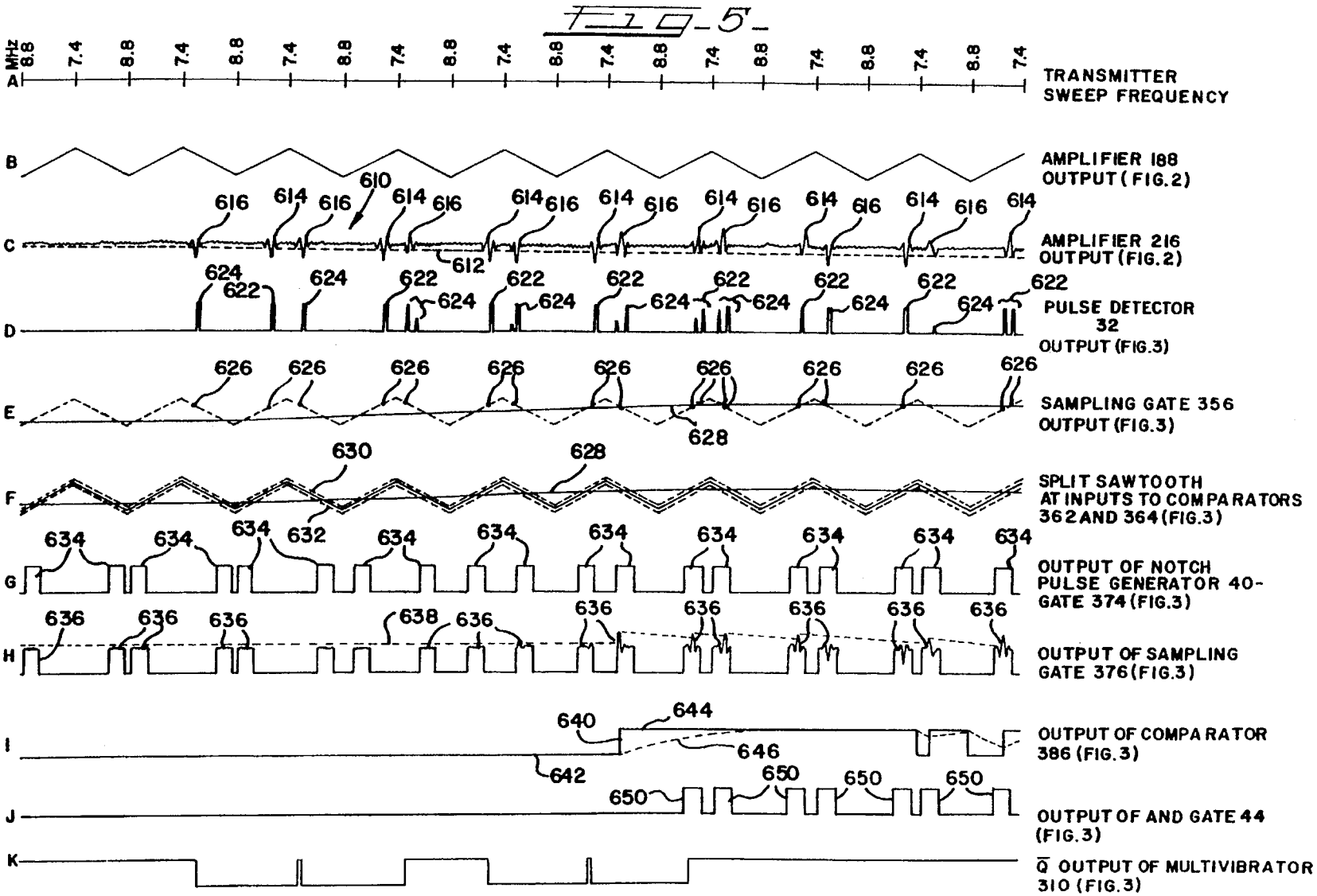

Referring now to FIG. 5, waveforms that occur at various points in the system when an interfering carrier is detected are shown. Also illustrated is how an interfering carrier or structural resonance is notched out if it has persisted for a sufficiently long period of time. FIG. 5A is similar to FIG. 4A and shows the sweep range of the transmitter frequency and is illustrated to provide a frequency reference for the other waveforms of FIG. 5. FIG. 5B is the same as FIG. 4C and illustrates the sawtooth output of the amplifier 188 of FIG. 2. FIG. 5C illustrates the analog signal resulting from an interfering carrier that appears at the output of the bandpass filter and gain circuit 26, specifically at the output of the amplifier 216 (FIG. 2). As is illustrated in FIG. 5C, an interfering carrier appears at about 7.7 mHz and appears twice per sweep. The perturbations caused by the interference in the detected output during increasing frequency sweeps are designated by the reference numeral 614 and the perturbations caused during decreasing frequency sweeps are designated as 616. The pulse detector 32 compares the analog signal 610 with the adaptive threshold 612 and provides an output when the analog signal 610 exceeds the threshold 612. The output signals from the pulse detector 32 are illustrated in FIG. 5D. As is illustrated in FIG. 5D, whenever the negative going portion of analog signal 610 exceeds the threshold 612, an output pulse 622 is generated. Whenever the positivegoing portion of signal 610 exceeds the threshold 612, an output pulse 624 is generated.

The pulses 622 and 624 from the pulse detector 32 control the detector sample and hold circuit 38 which samples the sawtooth waveform from the amplifier 188 each time a pulse is generated by the pulse detector 32. The samples of the sawtooth waveform are illustrated by a series of circles 626 in FIG. 5E that appear at the output of the sampling gate 356 and are integrated by the resistor 358 and the capacitor 360 to provide a voltage 628 on capacitor 360 that charges to the average value of the samples 626. The voltage 628 is compared with a pair of sawtooth waveforms 630 and 632 that are offset from the sawtooth waveform of FIG. 5B by the voltage divider action of a voltage divider comprising the resistors 366, 368, 370 and 372. The voltage at the junction of the resistors 366 and 368 illustrated by the waveform 630 is applied to the positive input of the comparator 362 of the notch pulse generator 40 and the voltage at the junction of resistors 370 and 372 is applied to the negative input of the comparator 364. The sampled integrated voltage from the sampling gate 356 is applied to the negative input of the comparator 362 and to the positive input of the comparator 364. The outputs of the comparators 362 and 364 are applied to the AND gate 374 which provides a positive output whenever both of its inputs are positive. The only circumstances under which both inputs to the AND gate 374 are high is when the amplitude of the voltage 628 is between the amplitude of the sawtooth voltages 630 and 632.

The output of the notch pulse generator 40, more particularly, at the output of the AND gate 374, is illustrated in FIG. 5G. The gate 374 generates a plurality of notch pulses 634, with each of the notch pulses 634 being generated when the amplitude of the voltage 628 is between the amplitudes of the voltages 630 and 632. When no pulses are present at the output of the pulse detector 32, the notch pulses 634 are generated at random, or not at all, but when the integrated voltage 628 approaches the average value of the samples 626 of the sawtooth waveform, the notch pulses 634 coincide in time with the detected output pulses 622 and 624 resulting from the interfering carrier, and can therefore be used to inhibit the detection of the interfering carrier or an interfering resonance. However, the system is designed so that the interfering carrier or resonance must persist for a predetermined amount of time that is longer than the time required for a tag to pass between the antennas 16 and 18 before the interference signal is gated out. The notch delay 42 is provided for this purpose. The notch delay circuit 42 contains the sampling gate 376 that samples the analog signal under the control of the notch pulse generator 40. The output of the sampling gate 376 at the capacitor 378 is illustrated in FIG. 5H. Note that upon the occurrence of each notch pulse 634, the analog signal is sampled to provide a plurality of sampled signal pulses 636 the peak value of which are rectified by diode 380 and stored by the capacitor 378 to provide a stored voltage 638. The voltage 638 builds as the pulses 636 increase in amplitude as they become aligned in time with and follow the signal increase of sampled analog pulses 614 and 616 until the voltage 638 exceeds the reference voltage applied to the negative terminal of the comparator 386.

The output of the comparator 386 is illustrated in FIG. 5I and has a transition point 640 between a low state 642 and a high state 644 that occurs when the voltage 638 exceeds the reference voltage. However, the voltage from the comparator 386 is applied to a slow attack, fast decay circuit consisting of the resistors 390 and 392, the capacitor 388 and the diode 394 which provides a slow transition 646 in response to the rapid transition 640 of the comparator 386. Transition 646 is shown in FIG. 5 disproportional to the actual rise time, which can be as long as several seconds. The signal from the slow attack, fast decay circuit including the transition 646 is applied to the AND gate 44 whose output is illustrated in FIG. 5J. Thus, the AND gate 44 provides a series of output pulses 650 only when the output of the slow attack, fast decay circuit is high. These pulses are applied to the multivibrator 310 and serve to inhibit the detection of the pulses from the pulse detector 32 so that the output of the processor 34 is not retriggered by the detected pulses resulting from an interfering carrier or resonance. Thus, the interfering carrier or resonance is ignored and the output of the multivibrator 310 does not cause the adaptive threshold circuit 30 to desensitize the pulse detector 32.

Figure 6:
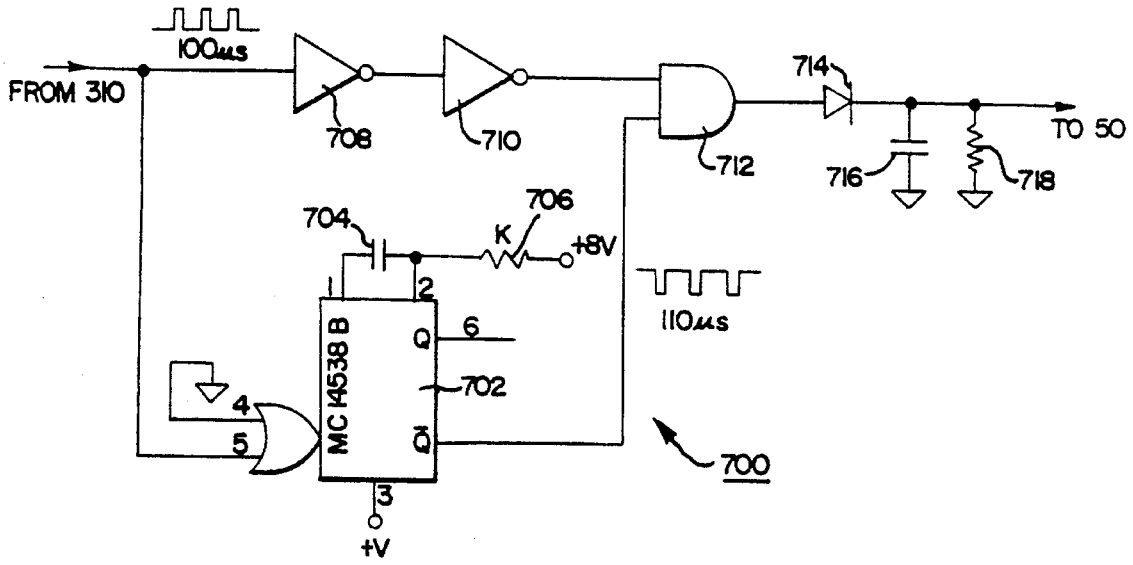
FIGS. 6 and 7 are schematic diagrams showing alternative ways to discriminate between synchronous and non-synchronous signals.

In the system described above, particularly in FIG. 3, the presence of a tag was determined by sampling the sawtooth waveform under the control of the processor 34 and providing an indication of the presence of a tag when the sampled sawtooth waveform was in a steady state condition. The Sampling and detection were provided by the processor sample and hold circuit 46 and the steady state discriminator 48 previously described. However, although the processor sample and hold circuit 46 and the steady state discriminator 48 work well in detecting the synchronous signal produced by a tag, such a synchronous signal may be detected in other ways. One alternative way to detect the synchronous pulses generated by a tag is illustrated in FIG. 6. FIG. 6 shows a pulse width discriminator generally designated by the reference numeral 700 that may be utilized to replace the processor sample and hold circuit 46 and the steady state discriminator 48 of FIG. 3 to detect the presence of a valid tag signal. The pulse width discriminator circuit illustrated in FIG. 6 includes a multivibrator circuit 702 that operates in conjunction with a capacitor 704 and a resistor 706 to provide a monostable multivibrator circuit. The pulse discriminator circuit also includes pulse coincidence determining circuitry, including a pair of gates 708 and 710 and an AND gate 712. A detection circuit, including a diode 714, a capacitor 716 and a resistor 718 detects the output of the AND gate 712.

In operation, the $\bar{Q}$ output of the multivibrator 310 is applied to the gate 708 and to an input of the multivibrator 702. When used in conjunction with the pulse width discriminator circuit 700, the timing of the multivibrator 310 is set so that it times out in approximately 5.5 milliseconds, or about 97% of the transmitter sweep time. As previously discussed, when a tag is present, the $\bar{Q}$ output of the multivibrator 310 is a series of narrow pulses as illustrated in FIG. 4G. When the timing of the multivibrator 310 is set to time out at 97% of the transmitter sweep time, these pulses will have a pulse width of approximately 100 microseconds. These 100 microsecond pulses are applied to the multivibrator 702 which is set to time out in approximately 110 microseconds. Thus, each time the multivibrator 702 is triggered, it provides a 110 microsecond output pulse at the $\bar{Q}$ output thereof. However, the polarity of the output pulse from the multivibrator 702 is opposite that of the polarity of the output pulses from the multivibrator 310.

The opposite polarity pulses from the multivibrator 310 and the multivibrator 702 are compared by the AND gate 712. However, because the multivibrator 702 has a slight time delay associated with it, the inverted polarity pulses from the multivibrator 702 are slightly delayed in time relative to the pulses from the multivibrator 310. Accordingly, the pulses from the multivibrator 310 are delayed by a delay circuit, comprising, in the illustrated embodiment, a pair of gates 708 and 710 which serve to delay the pulses from the multivibrator 310 by an amount approximately equal to the time delay of the multivibrator 702 so that the pulses applied to the AND gate 702 will be coincident in time when a synchronous signal, such as a tag signal, is being detected.

When a synchronous signal such as a tag signal is being detected, a series of 100 microsecond wide positive going pulses is applied to the AND gate 712 from the multivibrator 310. Concurrently, 110 microsecond wide negative going pulses are applied to the AND gate 712 from the multivibrator 702. Thus, the AND gate 712 is disabled by the pulses from the multivibrator 702 for a 110 microsecond period each time a pulse is received from the multivibrator 310. Hence, there is no signal present at the output of the gate 712 when synchronous pulses, such as tag pulses, are being detected. However, when noise or no tag is present, the output pulses from the multivibrator 310 are substantially wider than they are when a tag is present, as is illustrated by the regions 526 and 530 of FIG. 4G. However, the negative going pulses from the multivibrator 702 will always have a pulse width of 110 microseconds. Thus, any signal received from the multivibrator 310 that has a pulse width wider than the 110 microsecond pulse from the multivibrator 702 will provide a high state signal at the output of the gate 712. This output is detected by the detector circuit comprising the diode 714, the capacitor 716 and the resistor 718 to provide a positive output signal when no tag or noise is present. However, when a tag is detected, the pulses from the AND gate 712 will cease, and the output of the detector will go low to indicate the presence of a tag.

In another alternative embodiment, a phase locked loop may be used in place of the processor sample and hold circuit 46 and the steady state discriminator 48 to detect a steady state condition indicative of the presence of a tag signal. Briefly, this may be done by using a phase locked loop to lock on to the output signal provided by the multivibrator 310 of the processor 34 and monitoring the control voltage of the phase locked loop to determined whether the phase locked loop has achieved a locked condition. Typically, when a valid tag signal is present, the output of the multivibrator 310 will consist of regularly spaced pulses that the phase locked loop is able to lock on to. Under such conditions, the control voltage for the phase locked loop will be a relatively stable voltage. However, in the absence of a valid tag signal, the output of the multivibrator will consist of random pulses that the phase locked loop will be unable to lock on to. Under such conditions, the control voltage of the phase locked loop will fluctuate as the loop attempts to achieve a locked condition. Thus, by monitoring the control voltage of the phase locked loop to determine a steady state condition, the presence of a tag may be ascertained.

Figure 7:
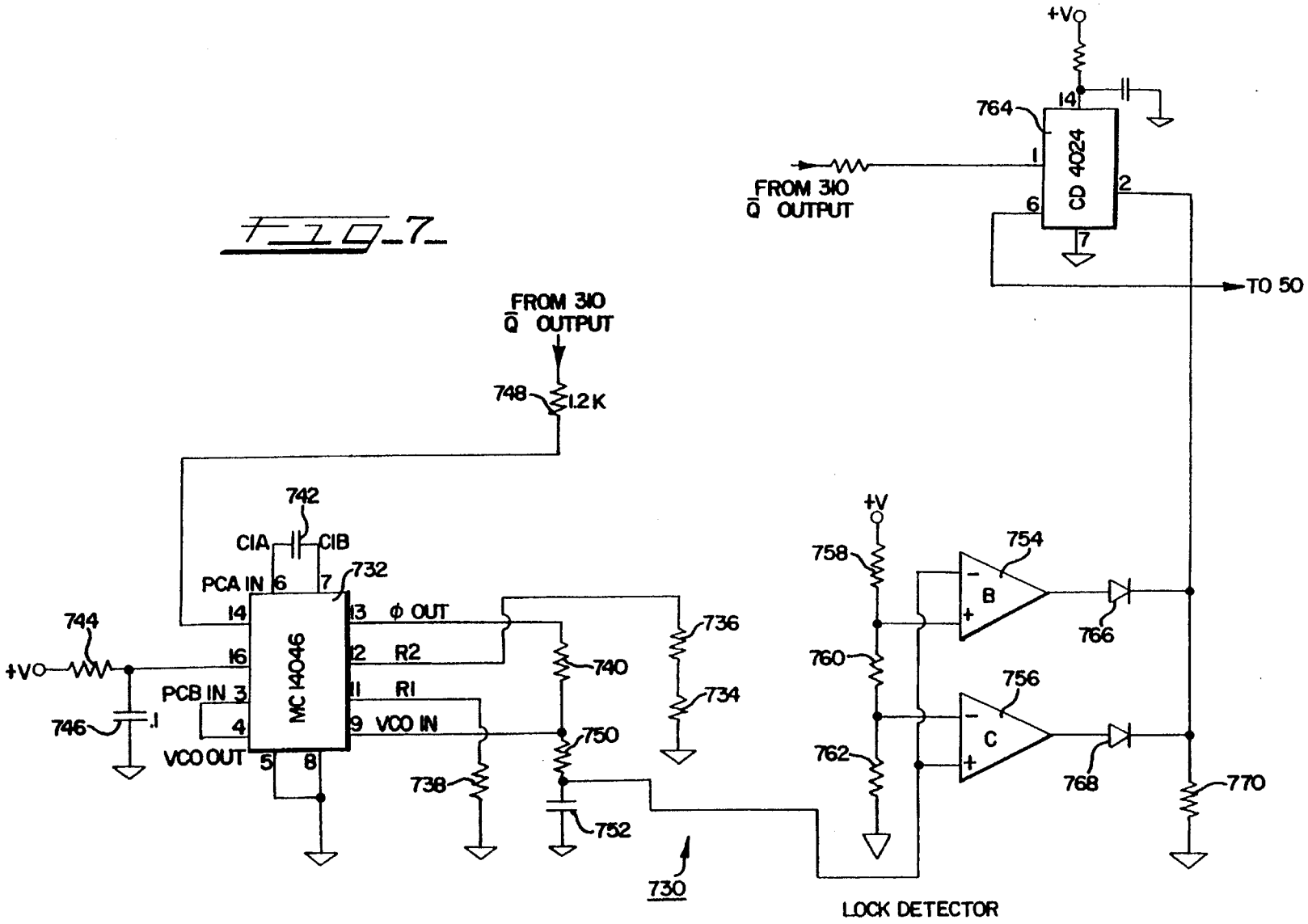

Referring to FIG. 7, there is shown a phase locked loop detector circuit capable of detecting a synchronous signal of the type produced by a tag. The circuit of FIG. 7 is designed to replace the processor sample and hold circuit 46 and the steady state discriminator 48 of FIG. 3 and is generally designated by the reference numeral 730 although the steady state discriminator 48 may be used as an alternate embodiment of a means to monitor the phase locked loop control voltage to detect lock. The circuit 730 utilizes a phase locked loop 732 that may be, for example, a type MC14046 phase locked loop manufactured by Motorola, Inc. that together with its associated components, including a variable resistor 734, resistors 736, 738 and 740 and a capacitor 742 forms a phase locked loop circuit. Power to the phase locked loop is provided by a filter circuit including a resistor 744 and a capacitor 746. The $\bar{Q}$ output signal from the multivibrator 310 is applied to the input of the phase locked loop 732 via a resistor 748. The control voltage for the voltage controlled oscillator of the phase locked loop 732 is filtered by a network including a resistor 750 and a capacitor 752 and monitored by a lock detector comprising a pair of comparators 754 and 756 and a voltage divider comprising resistors 758, 760 and 762. The outputs of the comparators 754 and 756 are applied to a counter 764 via a pair of diodes 766 and 768 in order to reset the counter 764 whenever the control voltage for the voltage controlled oscillator fluctuates. The MC14046 phase locked loop incorporates an internal lock detect circuit, with an output accessible by an external pin. This lock detect output may be used as another alternate means of detecting lock, although filtering may be required to eliminate voltage spikes. A counter suitable for use as a counter 764 is a type CD4024 counter manufactured by RCA, but other suitable counters may be used.

In operation, the phase locked loop 732 contains a voltage controlled oscillator that is phase locked to the $\bar{Q}$ output of the multivibrator 310. The coarse operating frequency of the voltage controlled oscillator is determined by the values of the resistors 734, 736 and 738 and the capacitor 742. Fine adjustment is determined by the amplitude of the voltage applied to the $VCO_{IN}$ input of the phase locked loop circuit 732. In order to achieve a phase locked condition, the phase locked loop 732 employs a phase comparator that compares the $\bar{Q}$ output from the multivibrator 310 applied to the $PCA_{IN}$ port of the phase locked loop 732 with the output of the voltage controlled oscillator within the phase locked loop 732 that is applied to the $PCB_{IN}$ terminal of the phase comparator from the $VCO_{OUT}$ terminal of the voltage controlled oscillator. The phase comparator compares the phases of the two aforementioned signals and provides a signal $\phi_{OUT}$ that is proportional to the phase difference between the two signals. The $\phi_{OUT}$ signal is applied to the $VCO_{IN}$ terminal of the voltage controlled oscillator and serves to adjust the frequency of the voltage controlled oscillator until its output is in phase with the Q output from the multivibrator 310.

When the $\bar{Q}$ output of the multivibrator 310 is periodic, indicative of the presence of a tag, the voltage appearing at the $VCO_{IN}$ terminal will remain at a relatively steady state. This voltage is filtered by the resistor 750 and the capacitor 752. The voltage appearing across the capacitor 752 is monitored by a window comparator including the comparators 754 and 756 to determine if the voltage across the capacitor 752 is in a predetermined range of voltages. The voltage across the capacitor 752 is compared by the comparators 754 and 756 with the voltages appearing at the junctions of the resistors 758 and 760, and at the junction of the resistors 760 and 762, respectively. As long as the voltage across the capacitor 752 is below the voltage at the junction of the resistors 758 and 760 and above the voltage at the junction of the resistors 760 and 762, as would be the case when a tag is present, neither of the comparators 754 or 756 provides an output signal. Thus, a low state signal is applied to the counter 764 via a resistor 770.

When the low state signal is applied to the counter 764, the-counter is enabled to count pulses from the Q output of multivibrator 310. The counter continues to count the pulses from the multivibrator 310 until a predetermined count is reached. For the CD4024 counter illustrated, various counts can be selected corresponding to counts of 1, 2, 4, 8, 16, 32 or 64, and when the selected count is reached, the counter 764 provides a signal to the alarm timer 50 to sound the alarm. Lower counts are preferable in low noise environments to minimize response time and maximize sensitivity, while higher counts are preferable in noisy environments to minimize false alarms. A count of 16 is suitable for a typical installation.

If a tag is not being detected, the $\bar{Q}$ output of the multivibrator 310 will not be a periodic signal, but more random in nature, thus making it difficult or impossible for the phase locked loop 32 to lock on to it. Under these circumstances, the phase differences between the signal from the $\bar{Q}$ output of the multivibrator 310 and the $VCO_{OUT}$ signal from the voltage controlled oscillator will change rapidly, and cause large fluctuations in the $\phi_{OUT}$ signal from the phase detector. This will result in a voltage across the capacitor 752 that swings over a range outside of the window defined by the resistors 758, 760 and 762, and one of the comparators 754 or 756 will provide an output pulse to the counter 764 via one of the diodes 766 and 768 to thereby reset the counter. Consequently, the counter 764 will be continuously reset and the required count to generate an alarm will not be achieved. However, if neither of the comparators provides an output, as would be the case when the voltage across the capacitor 752 is within the window defined by the resistors 758, 760 and 762, the counter 764 is not reset and can count to a value sufficient to cause an alarm to be sounded.

In the circuit illustrated in FIG. 3, the adaptive threshold was linear in that the rate at which the threshold was changed was dependent upon the values of the resistors 302, 304 and 306 and the capacitor 307, and the voltage across the capacitor 307, and hence the variable threshold voltage, increased in proportion to the amplitude of the feedback voltage applied to the resistor 304 regardless of whether the magnitude of the feedback voltage increased or decreased. Thus, when an interfering signal appeared, the detection threshold was gradually increased at a rate determined by the time constant of the variable threshold circuit. When the interfering signal disappeared, the detection threshold would then be gradually reduced at approximately the same rate.

Figure 8:
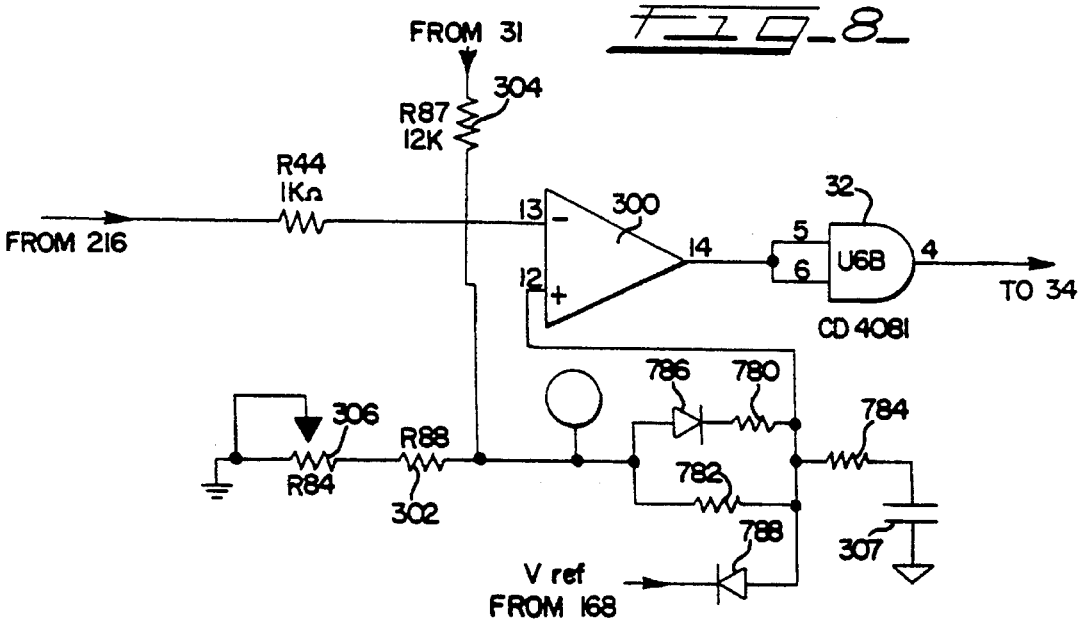
FIG. 8 illustrates an alternative embodiment of the adaptive threshold circuit of FIG. 3.

However, it has been found that when an interfering signal disappears, it is desirable to reduce the detection threshold more rapidly in order to rapidly return the system to full sensitivity quickly. This is accomplished by introducing non-linear circuit elements into the adaptive threshold circuit. Referring to FIG. 8, a non-linear circuit comprising resistors 780, 782 and 784 and diodes 786 and 788 has been added to the adaptive threshold circuit of the tag detector 300. The non-linear circuit permits the capacitor 307 to be charged or discharged at different rates depending on whether the value of the feedback voltage applied to the resistor 304 is increasing or decreasing. If the value of the feedback voltage decreases, as would be the case when an interfering signal first appears, the diode 307 would be discharged through the resistors 782 and 784 at a rate determined by the series resistance of the resistors 782 and 784. The resistor 780 would be effectively out of the circuit because the diode 786 would be reverse biased. If, however, the feedback voltage applied to the resistor 304 were increasing, as would be the case when an interfering signal disappears, the diode 786 would be forward biased and the capacitor 307 would be charged through the resistor 780 also. Consequently, the charge time of the capacitor 307 would be reduced, particularly if the value of the resistor 780 is smaller than the value of the resistor 782, thus permitting the adaptive threshold to be rapidly changed upon the cessation of an interfering signal. The diode 788 is coupled to the reference voltage from the Zener diode 168 (FIG. 2) and limits the maximum value of the reference voltage that may be applied to the tag detector 300.

It has been found that certain objects that may be present in the vicinity of a protected exit or that may be carried through a protected exit generate signals that are similar to tag signals. Examples of such objects are wire, particularly coiled wire, coiled wrapping paper, telephone cords and even swinging doors. These objects often have resonance characteristics that cause them to resonate within the swept frequency range of the system and generate a tag-like signal when they are present in or near the interrogation zone. However, it has been found that although such objects have a resonant frequency within the swept frequency range of the transmitter, the quality factor or the Q of such objects when they are in resonance is not as high as that of a tag. Consequently, the difference in Q can be utilized to discriminate between real tags and objects that have resonance characteristics similar to those of tags. As was previously described, the signal generated by a tag consists of a series of alternating polarity pulses that are generated when the transmitter sweep frequency passes through the resonant frequency of the tag. Such tag signals are illustrated by the waveforms designated by the reference numerals 514 and 516 in FIG. 4E, previously discussed. As is apparent from the waveform of FIG. 4E, the alternating polarity pulses 514 and 516 are relatively closely spaced in time, largely due to the impulse response of the bandpass filter and gain circuit 26, and generate one or more pulses 522 and 524 (FIG. 4F) when the threshold 512 is exceeded.

It has been found that a resonant object such as a coil of wire or other object that has a resonant frequency within the transmitter sweep frequency range generates a waveform similar to that of FIG. 4E. However, because the Q of such an object is lower than the Q of the tag, the spacing between the alternating polarity pulses is greater than the spacing between the alternating polarity pulses 514 and 516 shown in FIG. 4E. Consequently, when multiple pulses are generated by the pulse detector 32, the spacings between the pulses will be greater than the spacing between the pulses 524 of FIG. 4F, i.e., the frequency of the pulses produced by an object is lower than the frequency of the pulses produced by a tag. Thus, the spacing or the frequency of the pulses can be used to distinguish between pulses generated by a tag and a tag-like object.

Figure 9:
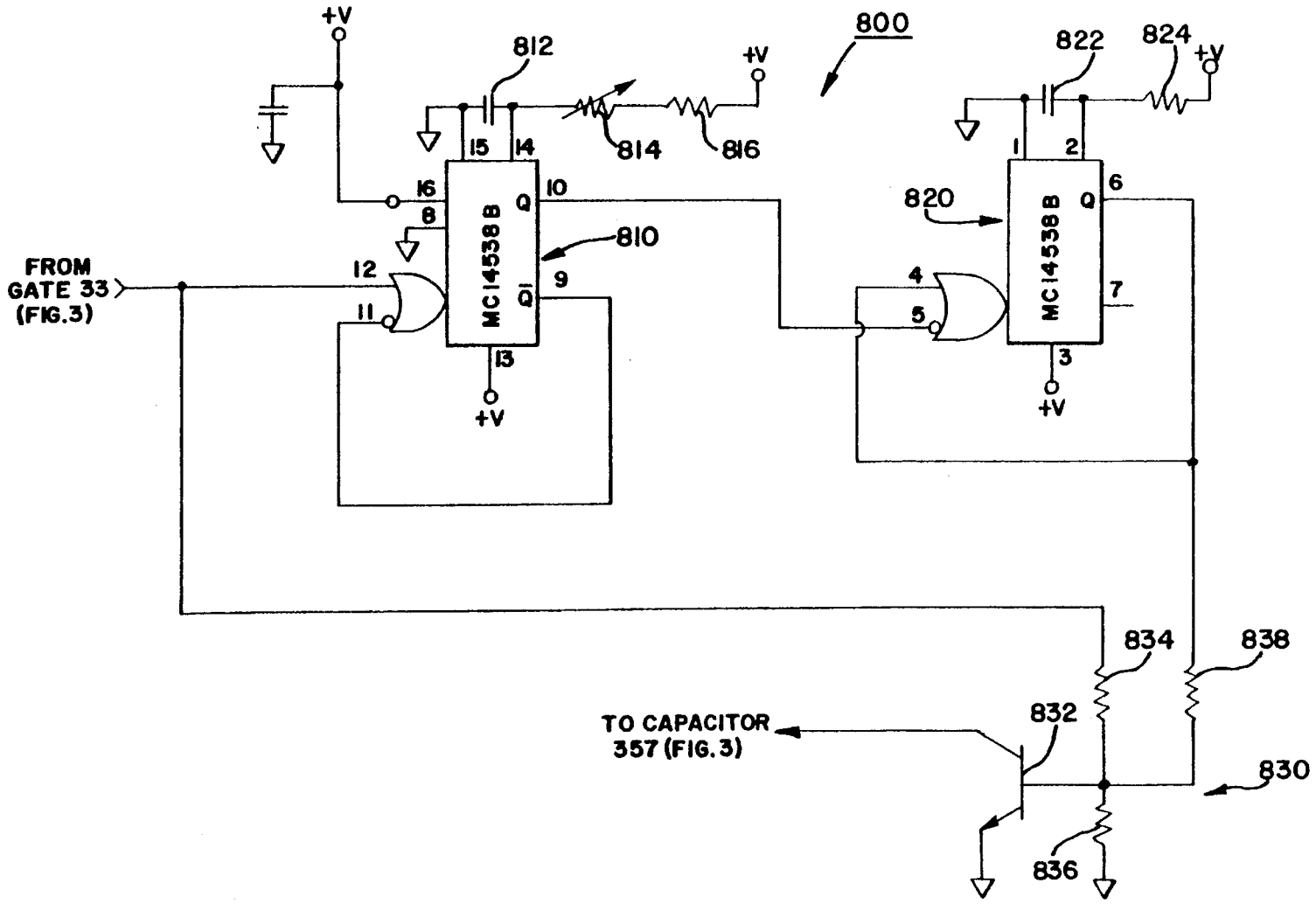
FIG. 9 is a schematic diagram of a circuit that discriminates between a real tag and other objects in the vicinity of the system that generate signals similar to those generated by a tag.

A circuit for detecting the presence of a tag-like object and inhibiting the generating of an alarm when such an object is detected is illustrated in FIG. 9. The discrimination circuit of FIG. 9, generally designated by the reference numeral 800, essentially operates as a timing circuit that prevents the generation of an alarm if the spacing between the pulses of a tag-like signal exceeds a predetermined amount. The discrimination circuit 800 utilizes a first monostable multivibrator 810, configured to be non-retriggerable, that receives pulses from the gate 33 of the pulse detector 32. The width of the individual pulses received from the gate 32 remains fairly constant, even though the amplitude of the tag-like signal being detected by the pulse detector 32 may vary. This is because the adaptive threshold circuit 30 causes the detection threshold to increase as the amplitude of the tag-like signal increases, so detection occurs near the peaks of the tag-like signal where pulse widths are fairly uniform. Each time a pulse is received from the gate 33, i.e., one of the pulses illustrated in FIG. 4F, the monostable multivibrator 810 generates a pulse as its Q output that has a time duration determined by a capacitor 812 and a pair of resistors 814 and 816. The time duration of this pulse is selected to be slightly longer than the time required for two pulses such as the pulses 524 produced by a tag to be generated. In the present embodiment which utilizes a transmitter sweep frequency of 178 Hz and a range from 7.4 mHz to 8.8 mHz, the time duration of the pulse generated by the multivibrator 810 is selected to be on the order of approximately 600 microseconds. Inasmuch as the circuit described above indirectly measures the frequency of the pulses by measuring the time required for two pulses to occur, it should be understood that the discrimination may be achieved by using either time or frequency measuring circuitry.

A second multivibrator 820 is triggered by the multivibrator 810 when the multivibrator 810 times out. The multivibrator 820 then generates a narrow pulse at its Q output that has a time duration determined by a capacitor 822 and a resistor 824. The duration of the output pulse from the monostable multivibrator 820 is selected to be on the order of approximately 100 microseconds and serves to generate a sampling window so that if a pulse from gate 33 is present during the sampling window, the generation of an alarm is inhibited.

In the, illustrated embodiment, the sampling of the tag-like signal and the inhibiting of the alarm is provided by a circuit 830 comprising a transistor 832 and resistors 834, 836 and 838. The circuit 830 operates as an AND gate that is enabled by the Q output of the monostable multivibrator 820 and samples the output from the gate 33 of the pulse detector circuit 32 so that if a pulse is present at the output of the gate 33 during the time that the Q output of the monostable multivibrator 820 is high, the transistor 832 is rendered conductive. The values of the resistors 834, 836 and 838 are selected so that a high output must be present at both the output of the gate 33 and the Q output of the monostable multivibrator 820 in order to render the transistor 832 conductive.

When the transistor 832 is rendered conductive, its collector is connected to ground potential and the signal at the collector may be used to inhibit the generation of an alarm. The generation of the alarm may be inhibited in various ways, and a convenient way is to inhibit the alarm timer 50 (FIG. 3). This can be readily accomplished by connecting the collector of the transistor 832 to the junction of the capacitor 357 and the resistor 359 to bring the $C_D$ input of the monostable multivibrator 350 to ground potential to thereby inhibit the alarm. After the inhibit window has passed, the capacitor 357 will be charged to a positive potential through the resistor 359, thus enabling the alarm timer 50.

Another situation potentially capable of generating false alarms is a transmitter failure. While a transmitter failure itself will not necessarily cause a false alarm to be generated, when a transmitter failure occurs, the receiver will lose its source of synchronization and be more susceptible to responding to spurious signals to generate an alarm. Thus, in accordance with another important aspect of the present invention, the synchronizing channel of the receiver is monitored to determine if a synchronizing signal is present and, if not, the system is inhibited so that a false alarm cannot be generated.

Figure 10:
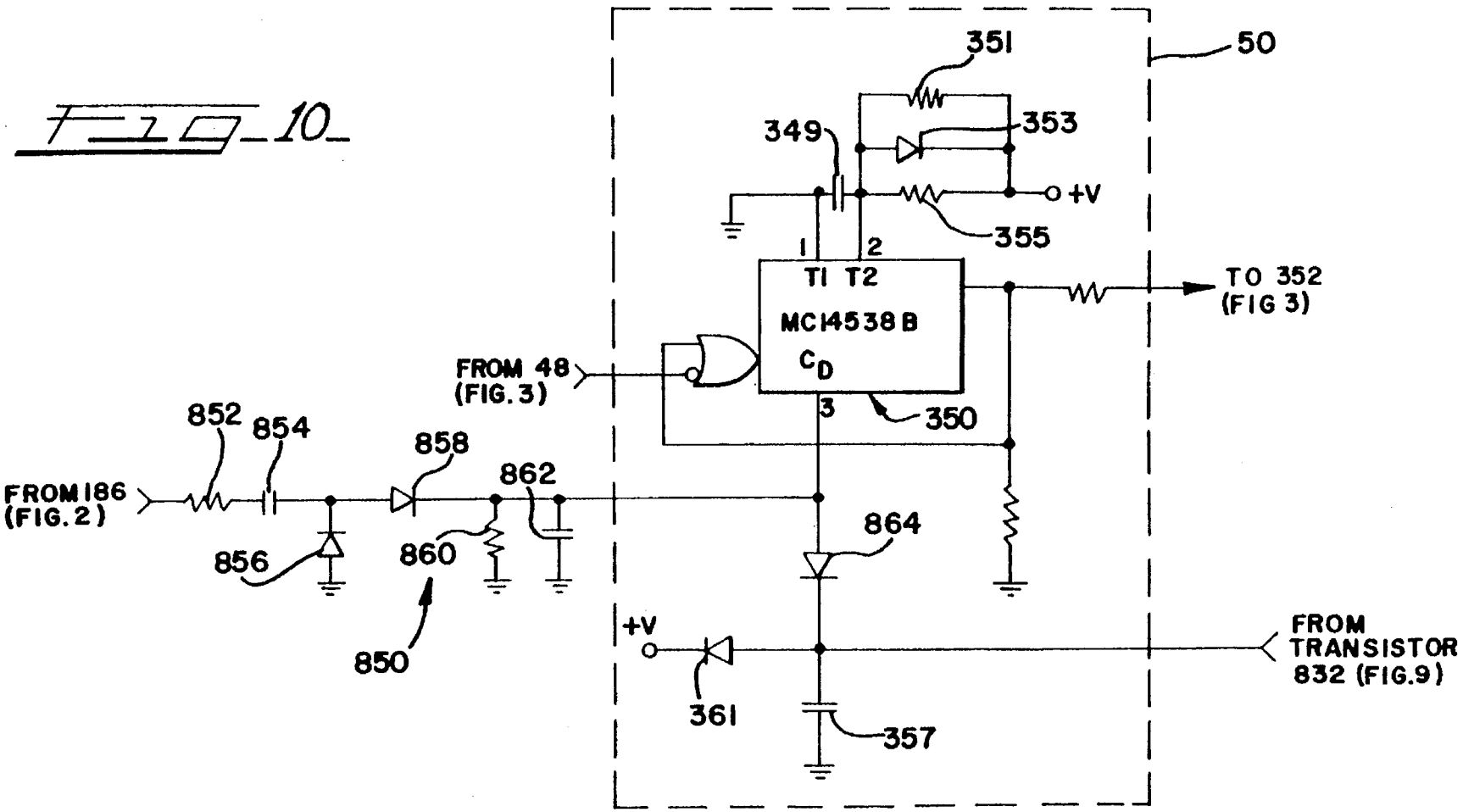
FIG. 10 is a circuit diagram of a circuit that disables the system in the event of a transmitter failure to prevent the generation of a false alarm.

The inhibiting of the alarm during a transmitter failure is accomplished by a circuit 850 (FIG. 10) that inhibits the alarm timer 50 upon the occurrence of a transmitter failure in much the same way as the alarm timer 50 was inhibited upon the detection of a tag-like signal that was not a true tag signal. In the embodiment illustrated in FIG. 10, the transmitter monitoring circuit 850 comprises an envelope detector comprising a pair of resistors 852 and 860, a pair of capacitors 854 and 862 and a pair of diodes 856 and 858. The circuit 850 monitors the synchronizing channel by monitoring the output of the gate 860 (FIG. 2); however, other points of the synchronizing channel could also be monitored, for example, the output of the amplifier 162 or the output of the amplifier 188, but the output of the gate 186 is particularly convenient to monitor because its output is a square wave (FIG. 4C) which swings between a power supply voltage and ground.

The output of the gate 186 is AC coupled to the diodes 856 and 858 through the resistor 852 and capacitor 854. The diodes 856 and 858 serve as a full wave detector or rectifier that charges the capacitor 862 to a positive potential when a square wave is present at the output of the gate 186; however, other types of demodulators including various amplitude, frequency and phase demodulators may be used. The resistor 860 discharges the capacitor to ground potential when the signal from the gate 186 is absent.

When the square wave from the gate 186 is present, the capacitor 862 is charged to a voltage approximately equal to that of the peak-to-peak value of the square wave from the gate 186. This voltage is applied to the $C_D$ pin of the alarm timer 350, thus enabling the alarm timer 350 as long as the square wave from the gate 186 is present. Thus, either the transmitter monitoring circuit 850, or the tag-like signal discriminating circuit 800, can disable the monostable multivibrator 350 of the alarm timer 50 by providing a low-state signal to the $C_D$ input of the monostable multivibrator 350. However, when both the transmitter monitor 850 and the tag-like signal discriminating circuit 800 are used to inhibit the multivibrator 350, the resistor 359 (FIG. 2) is eliminated, and the capacitor 357 is charged through a diode 864 rather than through the resistor 359.

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. An electronic article surveillance system for detecting the presence of a tag in a surveillance zone, comprising:

(1) a transmitter including (a) first signal generating means responsive to an input signal for generating radio frequency signals at different frequencies, (b) second signal generating means for generating input signals and applying the generated input signals to said first signal generating means, (c) modulating means for receiving said radio frequency and providing modulated radio frequency signals and (d) an antenna driven by the modulated radio frequency signals and establishing a radio frequency field in said surveillance zone; and (2) a receiver including (a) an antenna for outputting signals corresponding to said field and the presence of a tag therein, (b) processing means receiving said antenna output signals for detecting the presence of a tag in said surveillance zone, and (c) circuit means receiving said antenna output signals and operable, irrespective of the presence or absence of a tag in said surveillance zone, for synchronizing said processing means with said radio frequency signals by discerning the modulation content of said antenna output signals.

2. The system claimed in claim 1, wherein said modulating means is an amplitude-modulating means.

3. A method of providing synchronization between a transmitter of an electronic article surveillance system, adapted for detection of a tag in a surveillance zone in which said transmitter establishes a radio-frequency field, and a receiver of said system, irrespective of the presence or absence of a tag in said field, said method comprising the steps of:

(a) providing a preselected modulation in an output of said transmitter and hence in said radio-frequency field; and (b) synchronizing said receiver with said transmitter on the basis of detection in said receiver of said preselected modulation in said radio-frequency field.

4. The method claimed in claim 3, wherein said modulation is selected to be an amplitude modulation.

5. An electronic article surveillance system for detecting the presence of a tag in an interrogation zone having other signals therein, comprising:

transmitting means for providing a radio frequency field in said interrogation zone, said radio frequency field exhibiting frequency change with time and amplitude modulation;

detecting means receiving modulated radio frequency signals from the radio frequency modulated field and detecting the amplitude modulation thereof and generating a synchronizing signal exhibiting amplitude change with time correspondingly with the frequency change with time of said radio frequency signal; and discriminating means coupled to said detecting means for receiving as inputs signals produced by a tag in the interrogation zone and said other signals and for discriminating between said tag signals and said other signals by using the synchronizing signal generated by said detecting means.

6. An electronic article surveillance system as recited in claim 5 wherein said detecting means includes a coupling network.

7. An electronic article surveillance system for detecting the presence of a tag in an interrogation zone, comprising:

transmitting means for providing a radio frequency signal in said interrogation zone, said radio frequency signal exhibiting frequency change with time and amplitude modulation;

receiving means for receiving said modulated radio frequency signal and for receiving signals produced by a tag in the interrogation zone, said receiver means including circuit means for detecting the amplitude modulation in said modulated radio frequency signal and generating therefrom a synchronizing signal for said receiving means;

detecting means responsive to said receiving means for detecting the presence of tag signals and generating an indication of the detection thereof; and means for preventing the generation of said indication in the absence of generation of said synchronizing signal.

8. In an electronic article surveillance system of type including a transmitter for providing in a preselected area an electromagnetic field periodically swept in frequency over a predetermined range of frequencies for causing tags in said preselected area to generate tag signals containing a frequency within said predetermined range of frequencies and a receiver including detecting means for receiving said tag signals and providing output indication of detected tag signals, the improvement wherein said transmitter includes modulating means for modulating said electromagnetic field and wherein said receiver includes modulation responsive circuit means for synchronizing said detecting means with the frequency of said electromagnetic field.

9. The invention claimed in claim 8 wherein said modulation responsive circuit means includes a modulation detecting circuit.

10. The invention claimed in claim 8 wherein said modulation is an amplitude modulation and wherein said modulation detection circuit is an amplitude modulation detection circuit.

11. The invention claimed in claim 8 wherein said modulating means of said transmitter comprises an amplitude modulating means.

12. The invention claimed in claim 11 wherein said amplitude modulating means comprises a resistance-capacitance coupling network.

13. In a method for detecting article surveillance tags in a predetermined area by providing therein an electromagnetic field periodically swept in frequency over a predetermined range of frequencies for causing tags in said preselected area to generate tag signals containing a frequency within said predetermined range of frequencies and providing a receiver including detecting means for receiving said tag signals and other signals in said predetermined area not tag-generated but within said predetermined range of frequencies and providing output indication of detected tag signals, the improvement comprising the further steps of modulating said electromagnetic field and synchronizing said detecting means with the frequency of said electromagnetic field by detecting modulation therein.

* * * * *